US012753779B2

(12) United States Patent
Ku et al.

(10) Patent No.: US 12,753,779 B2
(45) Date of Patent: Oct. 6, 2026

(54) BLOWER

(71) Applicant: LG ELECTRONICS INC., Seoul (KR)

(72) Inventors: Myungjin Ku, Seoul (KR); Keunman Park, Seoul (KR); Kunyoung Lee, Seoul (KR); Bohyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/501,652

(22) Filed: Nov. 3, 2023

(65) Prior Publication Data

US 2024/0151246 A1 May 9, 2024

(30) Foreign Application Priority Data

Nov. 4, 2022 (KR) ..... 10-2022-0146103

(51) Int. Cl.
*F04F 5/16* (2006.01)
*F04F 5/44* (2006.01)

(52) U.S. Cl.
CPC . *F04F 5/16* (2013.01); *F04F 5/44* (2013.01)

(58) Field of Classification Search
CPC ..... F04F 5/16; F04F 5/44
See application file for complete search history.

(56) References Cited

U.S. PATENT DOCUMENTS

2014/0147297 A1 5/2014 Iyer et al.
2019/0170162 A1 6/2019 Jennings et al.
2021/0277913 A1* 9/2021 Kim ..... F04D 27/002

FOREIGN PATENT DOCUMENTS

JP 2021-188619 12/2021
KR 10-2021-0149486 12/2021

OTHER PUBLICATIONS

Korean Notice of Allowance dated Jan. 2, 2024 issued in Application No. 10-2022-0146103.

* cited by examiner

*Primary Examiner* — David N Brandt
(74) *Attorney, Agent, or Firm* — KED & ASSOCIATES, LLP

(57) ABSTRACT

A blower includes a housing through which air is introduced, a plurality of discharge ports disposed above the housing, each having a discharge port, and facing each other, a blowing space formed to be spaced at least partly between the plurality of discharge departments facing each other and open at least front and rear, a ground disposed on a downstream side of the blowing fan, spaced downward from the plurality of discharge departments, and connected to the housing, and a supporter extending upward from the ground to support the plurality of discharge departments. Accordingly, it is possible to improve blowing performance of the blower by reducing the occurrence of vortex through a pressure buffer zone formed by vertical separation of the ground and the discharge department, and structural stability of the blower can be improved by supporting the discharge department by the supporter and ground disposed inside the housing.

29 Claims, 19 Drawing Sheets

BLOWER

CROSS-REFERENCE TO RELATED APPLICATION(S)

This application claims priority under 35 U.S.C. § 119 to Korean Application No. 10-2022-0146103 filed in Korea on Nov. 4, 2022, whose entire disclosure(s) is/are hereby incorporated by reference.

BACKGROUND

1. Field

The present disclosure relates to a blower, and specifically, to a blower having excellent structural stability and blowing performance even when a plurality of discharge departments are provided at an upper portion.

2. Background

In general, a blower may be a mechanical device that causes air flow by driving a fan. In the blower of the related art, a method in which the fan is exposed to the outside to discharge air directly to the outer space has been mainly used.

Currently, a fan-less type blower is emerging, which conceals the fan in an inner space of the blower and has a separate discharge department formed for discharging air so that the fan is not visually exposed to an external user.

In particular, similarly to US 2019-170162 A1 (Jun. 6, 2019) and US 2014-0147297 A1 (May 29, 2014), as the related art, a blower is provided with a suction port at a lower portion of the blower and a plurality of discharge departments spaced apart from each other at an upper portion of the blower to improve a discharge air volume and use a Coanda effect.

However, he blower of the related art has a problem in that the blower is vulnerable to an external force that retracts or spreads the discharge department as the plurality of discharge departments are spaced apart.

Even when a load support structure for separately connecting the plurality of discharge departments is provided inside the blower in order to counter external force, the load support structure may cause a problem of increasing flow resistance.

BRIEF DESCRIPTION OF THE DRAWINGS

The embodiments will be described in detail with reference to the following drawings in which like reference numerals refer to like elements wherein.

DETAILED DESCRIPTION

Figure 1:
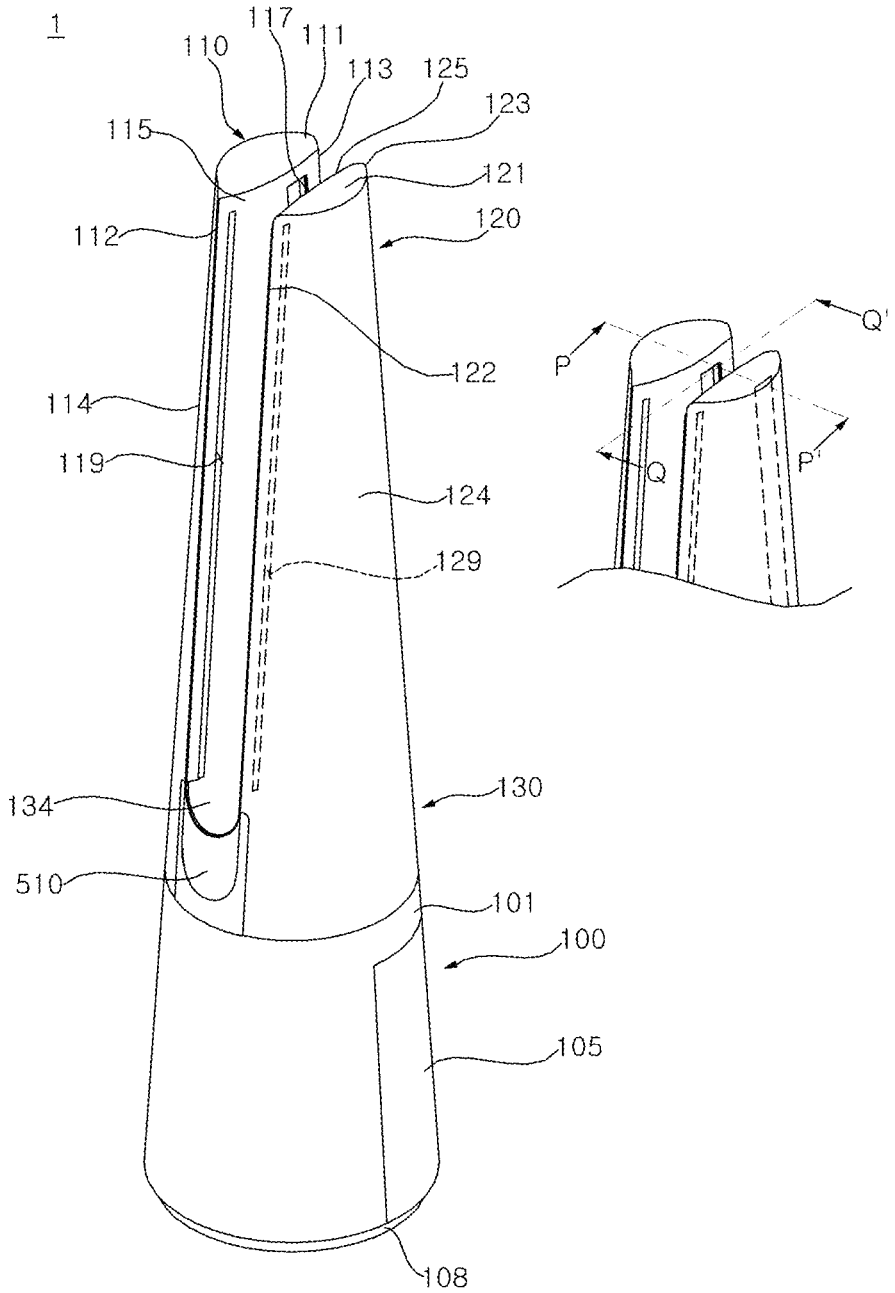
FIG. 1 is a perspective view of a blower according to an embodiment of the present disclosure.

Advantages and characteristics of the present disclosure, and methods for achieving them may become clearer with reference to the embodiments described later in detail in conjunction with the accompanying drawings. However, the present disclosure is not limited to the embodiments disclosed below and may be implemented in various different forms. That is, these embodiments only make the disclosure of the present disclosure complete and are provided to completely inform the scope of the description to those skilled in the art to which the present disclosure belongs, and the present disclosure may only be defined by the scope of the claims. Like reference numbers may refer to like elements throughout the specification.

Hereinafter, for example, reference number "134" may mean including reference numbers "134*a*", "134*b*", "134*c*", "134*d*", "134*e*", and "134*f*". Hereinafter, the front, rear, left, and right directions are only references arbitrarily set for explanatory convenience, and should not be understood as meaning absolute orientations. Hereinafter, "connected" in this description may include not only a case of being directly connected, but also a case of being indirectly connected by putting another configuration therebetween.

In this description, the flat cross-sectional area refers to a cross-sectional area viewed from a plan view. In this description, supporting a specific configuration may mean supporting a load of the specific configuration and fixing the specific configuration from an external force applied to the specific configuration.

First, a suction department, a distribution department, and a discharge department constituting a blower 1 according to the present disclosure will be described. The blower 1 according to the present disclosure includes a suction department 100, a distribution department 130, and discharge departments 110 and 120 (see FIG. 19).

The suction department 100 sucks outside air and supplies the outside air to the distribution department 130. The suction department 100 has a suction port 101 through which outside air is sucked. The suction department 100 may have a blowing fan 102*a* disposed therein. A filter 103 may be disposed inside the suction department 100. The inner space of the suction department 100 may be referred to as a suction space or a suction flow path.

The discharge departments 110 and 120 discharge air to an outer space. The discharge departments 110 and 120 has a discharge port through which external air is discharged. A plurality of discharge departments 110 and 120 are provided. A plurality of discharge departments 110 and 120 are connected in parallel to the distribution department 130. For example, the discharge departments 110 and 120 may include a first discharge department 110 and a second discharge department 120. The discharge departments 110 and 120 may have vanes therein. The inner space of the discharge departments 110 and 120 may be referred to as a discharge space or a discharge flow path.

The distribution department 130 distributes the air supplied from the suction department 100 to the plurality of discharge departments 110 and 120. The distribution department 130 may be disposed between the suction department 100 and the discharge departments 110 and 120. The distribution department 130 may connect the suction department 100 and the discharge departments 110 and 120. The plurality of discharge departments 110 and 120 are connected to the distribution department 130 in parallel. The inner space of the distribution department 130 may be referred to as a distribution space or a buffer space.

The distribution department 130 may be understood as a buffer space that buffers a pressure difference between the discharge space and the suction space in order to reduce a flow resistance generated in a process of distributing pressurized air discharged from a blowing fan 102*a* in the suction department 100 to the plurality of discharge departments 110 and 120.

The suction department 100 and the discharge departments 110 and 120 are connected to the lower and upper sides, respectively, with the distribution department 130 interposed therebetween. Accordingly, the blower 1 can discharge air at a higher position than the suction department 100.

Meanwhile, for convenience of description, the following will be described based on the case where the suction department 100 and the distribution department 130 are directly connected, and the distribution department 130 and the discharge departments 110 and 120 are directly connected. However, the core of the technical idea of the present disclosure is not limited by this, and it is natural that other configurations may be additionally disposed between each part.

In this description, a "department" means only a portion of the whole, and may not mean a part that is a basic unit in manufacturing or assembly. Accordingly, the description of each department separately in this description is merely dividing the portion for explanatory convenience, and may not mean that each department must be manufactured or assembled.

The blower 1 according to the present description includes a housing 160 through which air is introduced, the plurality of discharge departments 110 and 120 disposed on the upper side of the housing 160, each having a discharge port, and facing each other, and a blowing space Vb formed to be spaced at least partly between the plurality of discharge departments 110 and 120 facing each other and open at least front and rear. It can be understood that the plurality of discharge departments 110 and 120 are connected in parallel to the housing 160 with the blowing space Vb therebetween.

A blowing fan that forms the flow of air may be disposed on an upstream side of the inner space of the blower 1 than the upper portion of the housing 160. The air pressurized by the blowing fan 102*a* may flow upward and be distributed to the plurality of discharge departments 110 and 120 and then discharged to the outside.

In a structure in which a plurality of discharge flow paths are arranged in parallel, pressure loss and vortex may occur when pressurized air passing through the blowing fan 102*a* is distributed to the plurality of discharge flow paths. In order to reduce the pressure loss and vortex generation, it is necessary to provide a pressure buffer zone that alleviates the pressure difference between the vicinity of the blowing fan 102*a* and the discharge flow path.

In this regard, a distribution space Vd providing a relatively wide passage width may be provided between the blowing fan 102*a* (suction flow path) and the plurality of discharge flow paths.

Meanwhile, it can be understood that the plurality of discharge departments 110 and 120 are spaced apart from each other in a portion where the blowing space Vb is formed. Therefore, the plurality of discharge departments 110 and 120 in which the blowing space Vb, which is a spaced space open to the front and rear, is formed therebetween may be vulnerable to an external force (in particular, an external force that opens or closes the discharge department). Accordingly, it is necessary to separately support the plurality of discharge departments 110 and 120 inside the housing 160 to improve the structural stability of the blower 1. This is especially true in that a distribution space Vd requiring a wide flow path width is provided at the lower side of the discharge departments 110 and 120.

The blower 1 according to the present description includes a ground (or ground frame) 107 which is disposed on a downstream side of the blowing fan 102*a*, spaced downward from a plurality of discharge departments 110 and 120, and connected to the housing 160, and a supporter (or supporter frame) 132 which extends upward from the ground 107 to support the plurality of discharge departments 110 and 120.

Since the ground 107 is spaced downward from the discharge departments 110 and 120, the distribution space Vd, which is the pressure buffer zone, can be secured therebetween. The ground may be connected to the housing 160 to transmit a load to the housing 160. The ground 107 may be fixed by the housing 160. The ground 107 may support the supporter 132 on the upper side. The supporter 132 may be disposed in the distribution space Vd (upper side of the ground 107) and support the plurality of discharge departments 110 and 120. In this case, supporting a specific configuration may mean supporting a load of the specific configuration and fixing the specific configuration from an external force applied to the specific configuration. Therefore, at least a portion of the load of the discharge departments 110 and 120 can be transmitted to the housing 160 through the supporter 132 and the ground 107, and the load transmitted to the housing 160 can be transmitted to the ground.

In this way, in a structure in which the plurality of discharge departments 110 and 120 are arranged to face each other on the upper side of the housing 160 and the blowing space Vb is formed therebetween, the structural stability of the blower 1 can be improved by allowing the supporter 132 and the ground 107 disposed inside the housing 160 to support the discharge departments 110 and 120.

Meanwhile, since the supporter 132 is disposed in the distribution space Vd, it needs to be provided with an appropriate shape and arrangement to stably perform the role of load support while securing a sufficient flow path width. The specific shape and arrangement of the supporter 132 in this regard will be described later.

Hereinafter, the configuration of the blower 1 according to an embodiment of the present disclosure will be described in more detail with reference to the accompanying drawings.

First, the housing will be described with reference to FIGS. 4 to 8, 12, 13, and 19.

Air is introduced into the housing 160. The plurality of discharge departments 110 and 120 may be connected in parallel to the upper side of the housing 160. Air introduced into the housing 160 may flow upward and be distributed to each of the plurality of discharge departments 110 and 120. That is, in the present description, the housing 160 may be understood as a casing having an inlet through which air is introduced on one side and having the plurality of discharge departments 110 and 120 connected in parallel to the upper side. The housing 160 may provide a portion of an outer appearance of the blower 1 (see FIG. 19).

The shape of the housing 160 may be a shape having a periphery and opening up and down. For example, the shape of the housing 160 may be close to a cylindrical shape in which an upper surface and a lower surface are opened. For example, the shape of the housing 160 may be close to a truncated cone shape in which the upper and lower surfaces are open and the flat cross-sectional area decreases toward the upper side.

The specific shape of the housing will not limit the core of the technical idea of the present disclosure. For example, the housing 160 may have a box-shaped rectangular parallelepiped shape with open upper and lower surfaces. Even in this case, it is natural that the housing 160 can be understood as a casing having an inlet through which air is introduced on one side and having the plurality of discharge departments 110 and 120 connected in parallel on the upper side, and thus, it can be understood that the housing 160 having a box-shaped rectangular parallelepiped shape corresponds to the housing 160 of the present disclosure. However, for convenience of description, the housing 160 is described based on the case where the upper and lower surfaces are in the shape of a truncated cone with openings.

A plurality of discharge departments 110 and 120 may be connected to the upper side of the housing. An inner space of the discharge departments 110 and 120 and an inner space of the housing 160 may be in communication. The upper inner space of the housing 160 may be understood as the above-described distribution department 130 in that it is a space in which flowing air is distributed to the plurality of discharge departments 110 and 120. The ground 107 and the supporter 132, which will be described later, may be disposed in the upper inner space of the housing 160.

A blowing fan 102*a* may be disposed in a lower inner space of the housing 160. A filter cover 105 having a suction port 101 may be disposed below the housing 160. The filter 103 may be disposed inside the filter cover 105. After passing through the suction port 101 formed in the filter cover 105, the air passes through the filter 103 and is purified, and then can be pumped upward by the blowing fan 102*a*.

In this case, the lower portion of the housing 160 may be understood as the upper portion of the suction department 100 described above. In addition, the lower side of the housing 160 may be understood as the lower side of the suction department 100. The inner space of the lower portion of the suction department 100 and the inner space of the housing 160 may communicate with each other. The upper and lower portions of the suction department 100 may be manufactured as separate members and connected to each other.

Meanwhile, unlike the above, the lower portion of the housing 160 may provide the entire suction department 100. In this case, the suction port 101 and the filter 103 may be disposed below the housing 160. Alternatively, unlike the above, the housing 160 may provide only the distribution department 130. In this case, the blowing fan 102*a* may be disposed in a separate casing rather than the housing 160. As such, a relationship between the housing 160 and the suction department 100 is only a matter that may vary depending on the manufacturing unit of the blower 1, and will not limit the core of the technical idea of the present disclosure. However, for convenience of description, description will be made based on the case where the housing 160 provides the upper portions of the distribution department 130 and the suction department 100.

The housing 160 may be manufactured as an integral member, but for convenience, a sleeve (hereinafter, "outer sleeve") which is a member disposed on the outside and has a thickness, and a sleeve which is a member disposed on the inside and has a thickness (hereinafter referred to as "inner sleeve") may be each manufactured and then assembled into one. In this case, the outer surface of the outer sleeve may form the outer surface of the housing 160, and the inner surface of the inner sleeve may form the inner surface of the housing 160. In order to easily manufacture the outer and inner surfaces of a desired shape, the convenience of manufacturing the housing 160 can be improved by first manufacturing the outer sleeve and the inner sleeve, and then assembling them into one. This manufacturing method can be equally applied to the discharge department to be described later.

As illustrated in the accompanying drawings, the filter cover 105 corresponding to the outer sleeve of the suction department 100 extends upward, the outer sleeve (specifically, outer sleeves 114*o* and 124*o* of first and second outer departments 114 and 124 to be described later) of the discharge departments 110 and 120 extends downward, and then, the upper portion of the filter cover 105 and the lower portions of the outer sleeves of the discharge departments 110 and 120 may be collectively referred to as the outer sleeve of the housing 160. An upper end of the filter cover 105 and lower ends of the outer sleeves 114*o* and 124*o* of the outer departments 114 and 124 of the discharge departments 110 and 120 are connected at a height portion corresponding to the spoke 107*b* to be described later to form a smooth continuous surface.

As illustrated in the accompanying drawings, a rim 107*c* forming a periphery is provided, and the inner sleeves (specifically, inner sleeves 114*i* and 124*i* of the first and second outer departments 114 and 124 to be described later) of the discharge departments 110 and 120 extend downward, and then, the rim 107*c* and the lower portions of the inner sleeves of the discharge departments 110 and 120 may be collectively referred to as the inner sleeve of the housing 160. It can be understood that the lower end of the rim 107*c* in height is the lower end of the housing 160. The upper end of the rim 107*c* may be connected to lower ends of the inner ribs 114*i* and 124*i* of the outer departments 114 and 124 of the discharge departments 110 and 120 to form a smooth continuous surface.

Figure 8:
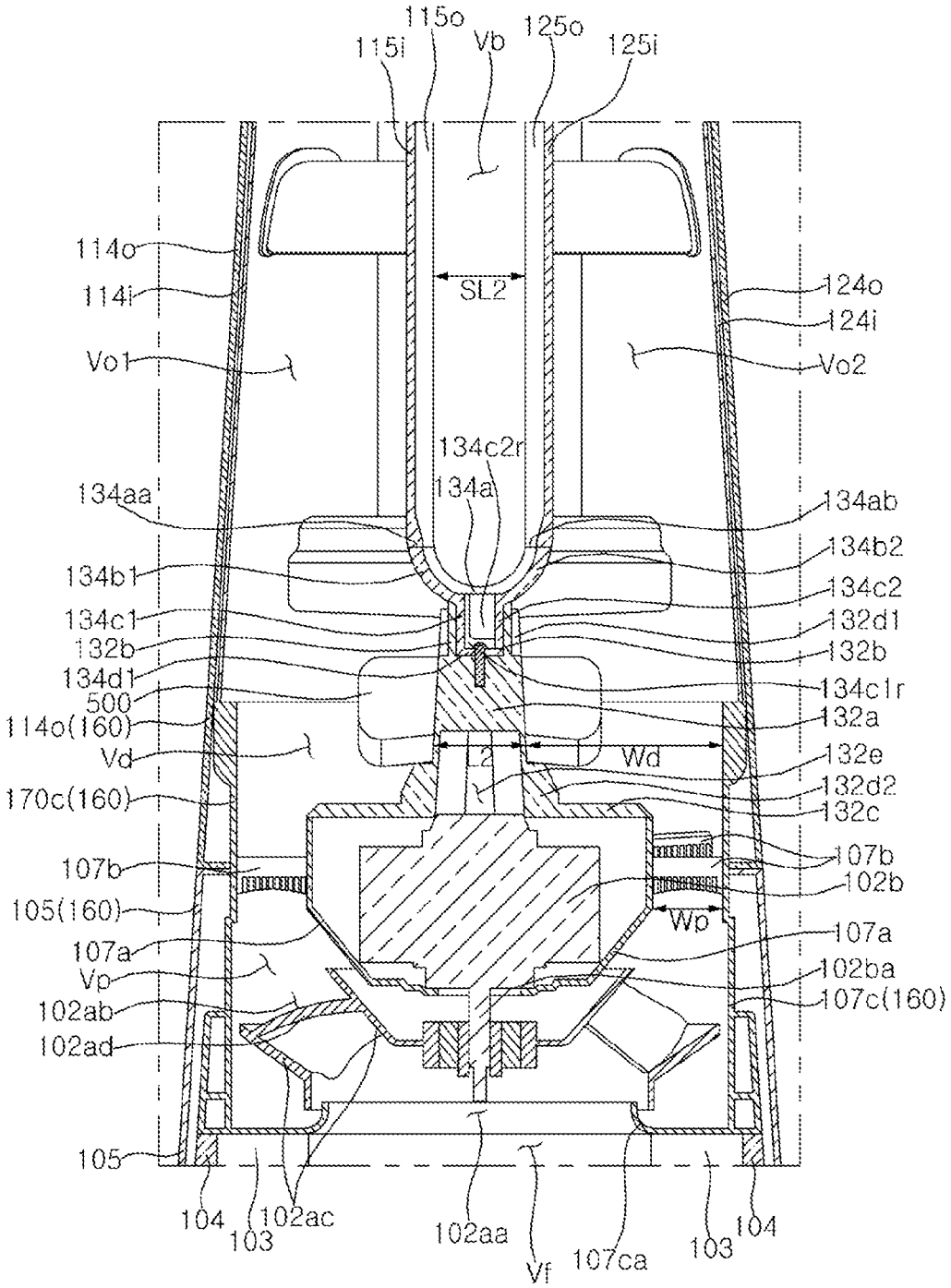
FIG. 8 is an enlarged view of A of FIG. 4.
Figure 9:
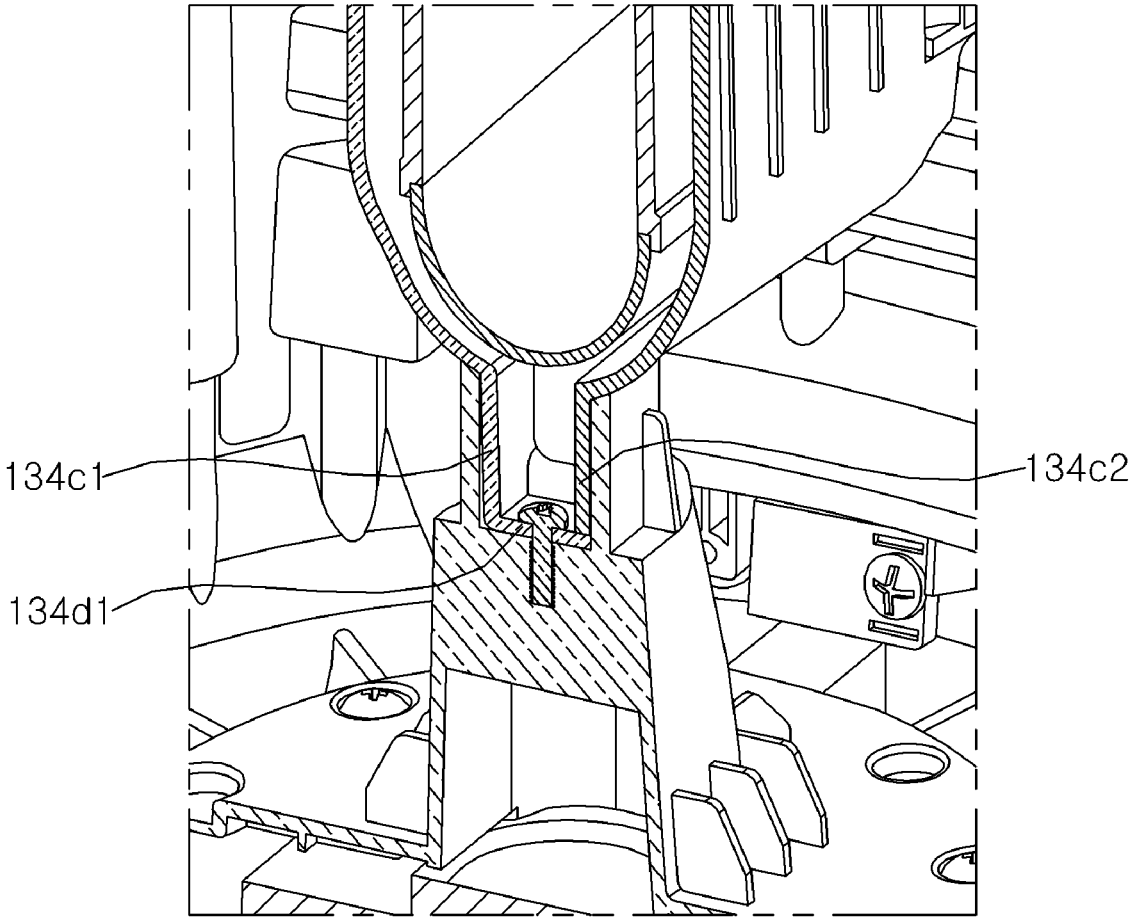
FIG. 9 is an enlarged view of A of FIG. 5.
Figure 10:
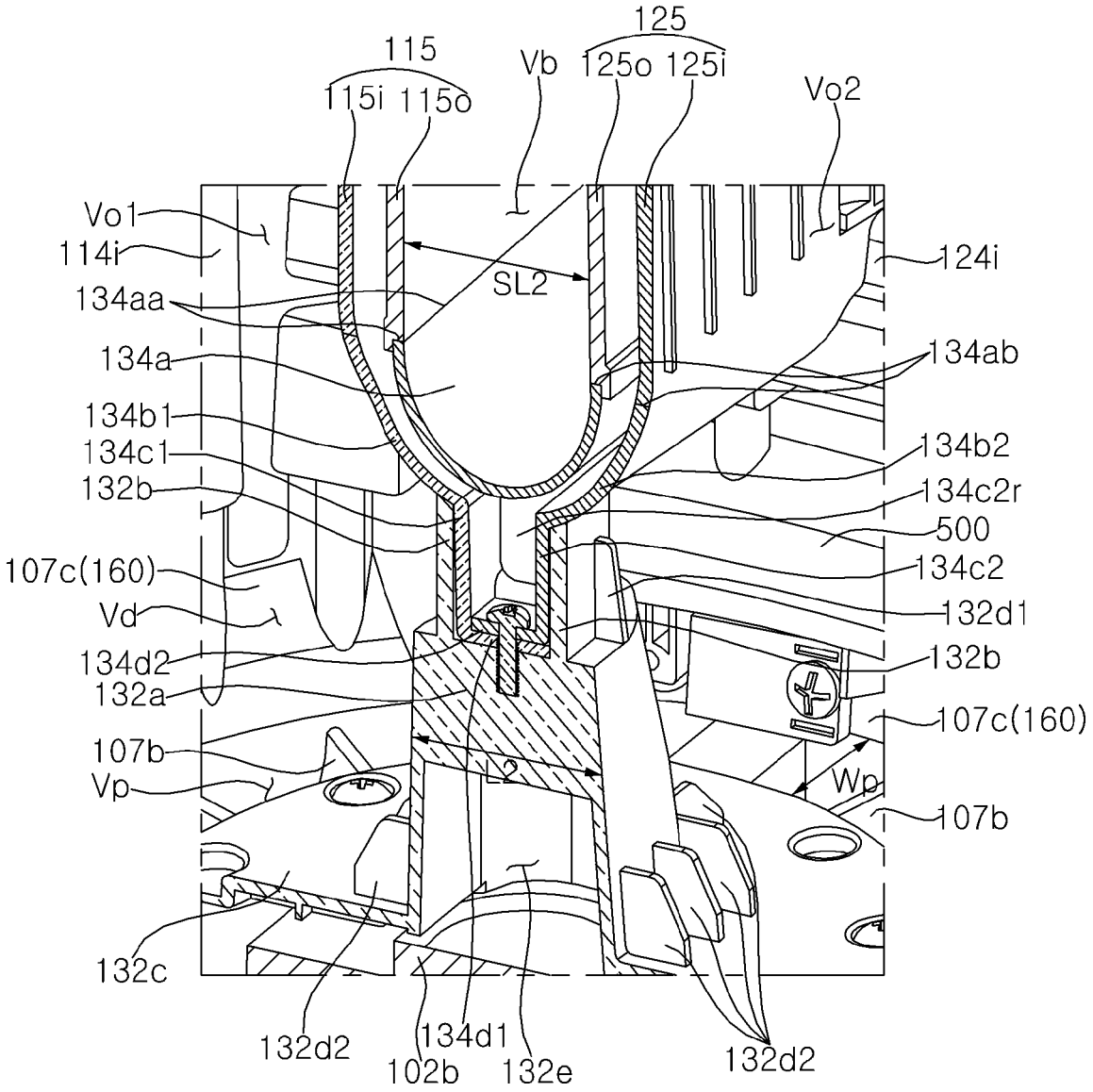
FIG. 10 is an enlarged perspective view of a cross section of a supporter according to another embodiment of the present disclosure.
Figure 12:
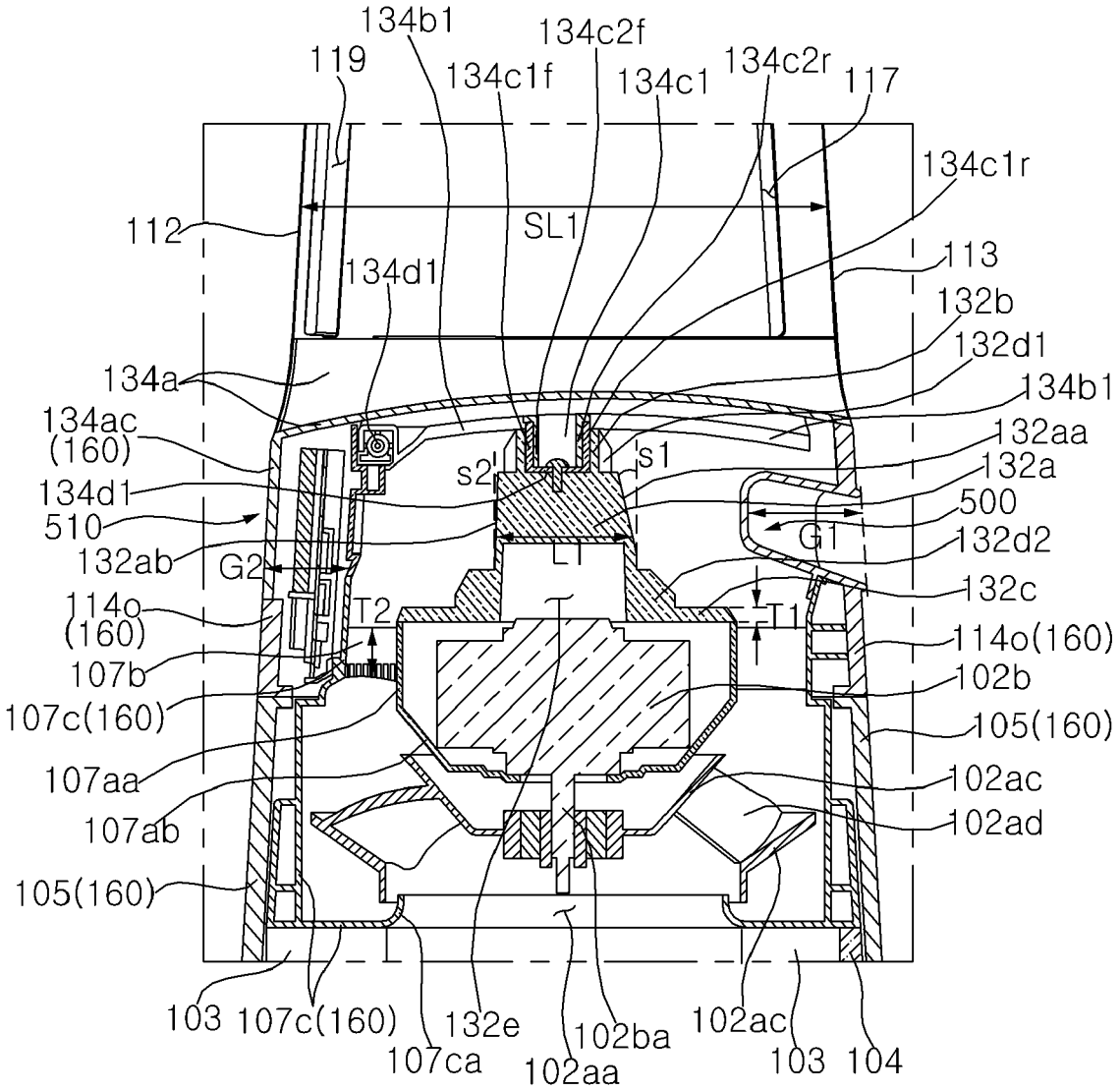
FIG. 12 is an enlarged view of A of FIG. 6.
Figure 13:
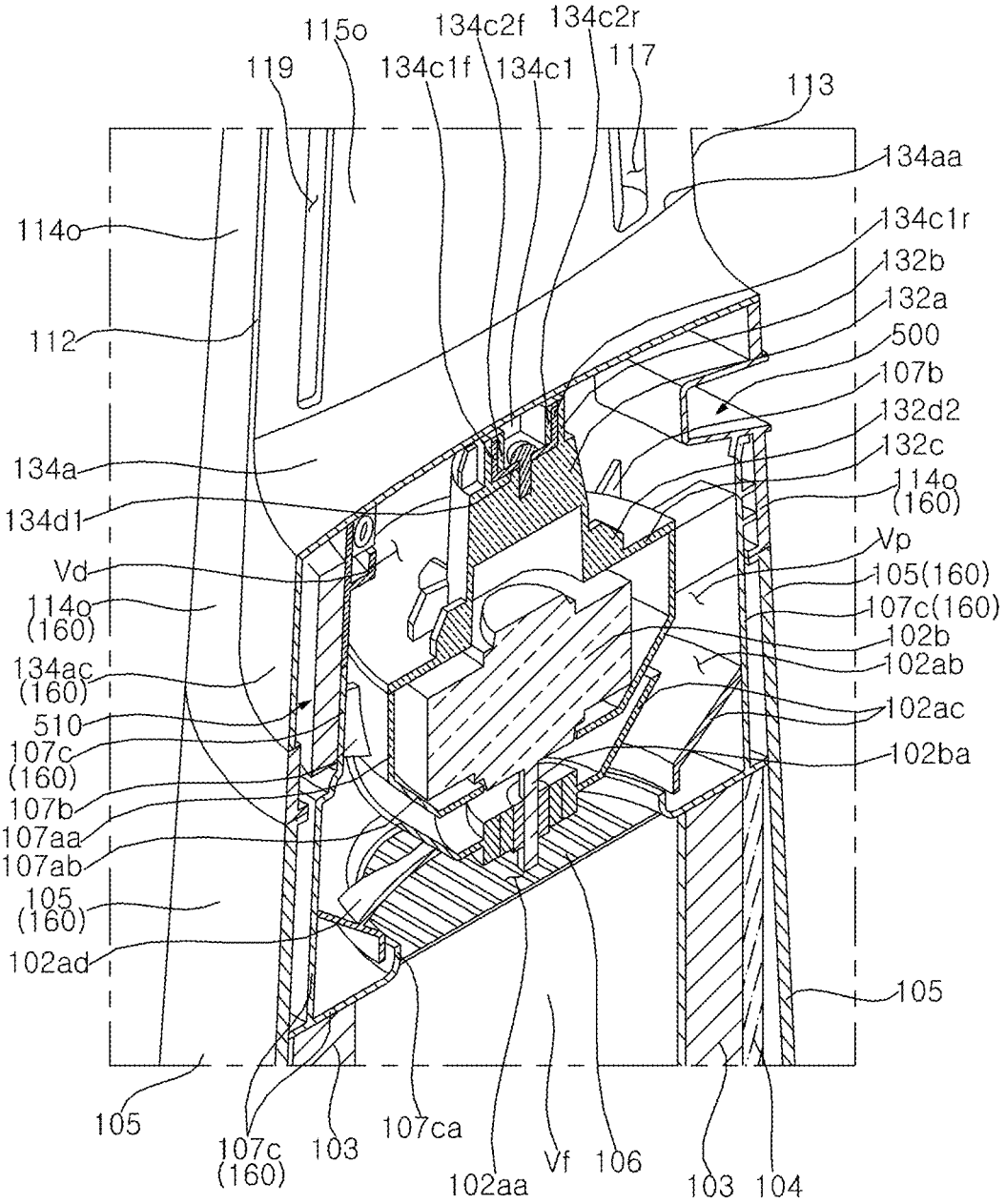
FIG. 13 is an enlarged view of A of FIG. 7.

Referring to FIGS. 8, 9, and 12, the rim 107*c* may constitute at least a portion of the inner sleeve of the housing 160. The rim 107*c* may have a cylindrical shape in which an upper surface and a lower surface are opened. Alternatively, the rim 107*c* may have a truncated cone shape in which an upper surface and a lower surface are opened and a flat cross-sectional area decreases toward the upper side.

The supporter 132, the ground 107, and/or the blowing fan 102*a*, which will be described later, may be disposed inside the rim 107*c*. The blowing fan 102*a*, the ground 107, and/or the supporter 132 may be sequentially disposed inside the rim 107*c* from the bottom to the top.

The blowing fan 102*a* and/or the ground 107 may be disposed in a central portion on planar cross-section inside the rim 107*c*. The ground 107 (specifically, a hub 107*a* to be described later) may be spaced apart from an inner periphery surface of the rim 107*c* by a predetermined distance. A spaced space between the inner periphery surface of the rim 107*c* and the ground 107 (specifically, the hub 107*a* to be described later) may be referred to as a pressurized space Vp. The pressurized space Vp can be understood as a space for pressurizing air by forming a flow path narrower than other portions in the blower 1.

A lower end of the rim 107*c* may extend in a radially inward direction to form an opening whose area matches that of an air inlet 102*aa* of the blowing fan 102*a* to be described later. In addition, the rim 107*c* may be formed along the periphery of the opening and form a curved bell mouth 107*ca* having an upward inclination in the direction of a rotation axis. The bell mouth 107*ca* guides the air passing through the filter 103 to the air inlet 102*aa* of the blowing fan 102*a* to improve air flow.

The inner surface of the rim 107*c* may be formed as a smooth continuous surface in consideration of the flow of air. The upper portion of the filter cover 105 and the lower portions of the outer sleeves 114*o* and 124*o* of the outer departments 114 and 124 of the discharge departments 110 and 120 may be connected to the outer surface of the rim 107*c*. An upper portion of the filter cover 105 may be connected to a lower portion of the outer surface of the rim 107*c*. The lower portions of the outer sleeves 114*o* and 124*o* of the outer departments 114 and 124 of the discharge departments 110 and 120 may be connected to the upper portion of the outer surface of the rim 107*c*.

Hereinafter, it is natural that the inner sleeve of the housing 160 and the outer sleeve of the housing 160 can be collectively referred to as the housing 160 in brief. The upper side of the filter 103 in height to the lower side of the bridge 134 may be referred to as the housing 160. The bridge 134 and the upper portion of the bridge 134 in height may be referred to as the discharge departments 110 and 120 (see FIG. 19).

However, the description of a manufacturing unit of the housing 160 described above is only an example, and thereby the core of the technical idea of the present disclosure should not be limited. For example, the housing 160 may be manufactured by assembling a front sleeve forming a front surface and a rear sleeve forming a rear surface. However, for convenience of description, it will be described based on the manufacturing unit of the housing 160 as illustrated in the accompanying drawings.

Referring to FIGS. 4 to 8, 12, and 13, the blowing fan 102*a* may be disposed inside the blower 1. According to one embodiment of the present disclosure, the blowing fan 102*a* may be disposed inside the housing 160. The blowing fan 102*a* may be disposed in the lower inner space of the housing 160. The blowing fan 102*a* may be disposed below the ground 107 to be described later.

The blowing fan 102*a* blows the introduced air upward. The blowing fan 102*a* can suck air from the lower side and pressurization-feed the air to the upper side. Air passing through the suction port 101 and the filter 103 of the blower 1 may be discharged upward after being pressurized by the blowing fan 102*a*.

For example, the rotation axis of the blowing fan 102*a* may be arranged in an up-down direction. The rotational axis of the blowing fan 102*a* may be disposed coincident with the center in planar cross-section of the inner space of the housing 160. In this case, the blowing fan 102*a* may be an axial fan or a mixed flow fan having the air inlet 102*aa* opened toward the lower side. In this case, the blowing fan 102*a* may have the air inlet 102*aa* on the lower side and an air discharge port 102*ab* on the upper side. The air inlet 102*aa* of the blowing fan 102*a* may coincide with the air inlet (or the opening of the rim 107*c*) of the housing 160.

Preferably, the blowing fan 102*a* may be the mixed flow fan. In general, it is known that the mixed flow fan has a smaller volume and less noise than the axial fan. In the mixed flow fan, a plurality of blades 102*ad* having an inclination of about 45 to 55 degrees upward with respect to the radial direction may be arranged about a rotation axis in the up-down direction, and a pair of shrouds 102*ac* having an inclination of about 45 to 55 degrees upward with respect to the radial direction may be spaced apart vertically with the blades 102*ad* interposed therebetween.

The air introduced into the air inlet 102*aa* of the blowing fan 102*a* may be introduced between a pair of shrouds 102*ac*, pressurized by the rotating blades 102*ad*, and then discharged to the air discharge port 102*ab* of the blowing fan 102*a*.

However, since the mixed flow fan forms an airflow that obliquely flows in a radially outward direction with respect to the axial direction, a diffuser (that is, the ground 107 including a hub 107*a* and a spoke 107*b*) to be described later may be necessary to be provided to convert the airflow discharged from the fan in an upward direction.

Hereinafter, the discharge departments 110 and 120 and the blowing space Vb will be described in detail.

In the present disclosure, the plurality of discharge departments 110 and 120 are provided. At least some of the plurality of discharge departments 110 and 120 may be spaced apart from each other. The plurality of discharge departments 110 and 120 may be connected to an upper side of the distribution department 130. The plurality of discharge departments 110 and 120 are arranged in parallel with each other. Each of the plurality of discharge departments 110 and 120 has a discharge port. Each of the discharge departments 110 and 120 receiving air distribution from the distribution department 130 may discharge air to the outside through the discharge port.

For example, as illustrated in the accompanying drawings, the discharge departments 110 and 120 may include a first discharge department 110 and a second discharge department 120 connected to the upper side of the housing 160. The core of the technical idea of the present disclosure is not limited to the number of discharge departments. However, hereinafter, for convenience of description, the case of two discharge departments will be described.

The second discharge department 120 may face the first discharge department 110. For example, the first discharge department 110 and the second discharge department 120 may be completely spaced apart from each other to form parallel "II" shaped discharge departments. However, the fact that the second discharge department 120 faces the first discharge department 110 may not mean that the second discharge department 120 and the first discharge department 110 must be completely separated from each other. For example, the first discharge department 110 and the second discharge department 120 may be partially connected to each other.

For example, lower end portions of the first discharge department 110 and the second discharge department 120 may be connected to each other, upper end portions of the first discharge department 110 and the second discharge department 120 may be connected to each other, and intermediate portions of the first discharge department 110 and the second discharge department 120 may be spaced apart from each other to form an "O" shaped discharge department as a whole. In this case, the spaced space between the first discharge department 110 and the second discharge department 120 may be opened in a horizontal direction.

Alternatively, as illustrated in the accompanying drawings, only the lower end portions of the first discharge department 110 and the second discharge department 120 may be connected to form a "U" shaped discharge department as a whole. In this case, the spaced apart space between the first discharge department 110 and the second discharge department 120 may be opened in a horizontal direction and upward.

In this way, the overall shape of the discharge department may be modified, but unless otherwise specified, for convenience of description, a case where only the lower end portions of the first discharge department 110 and the second discharge department 120 are connected to each other to form a discharge department having a "U" shape or a shape close to the "U" shape will be described as a reference. In this case, a portion connecting the lower portions of the first discharge department 110 and the second discharge department 120 may be referred to as the bridge 134. A detailed description of the bridge 134 will be described later. In this case, the first discharge department 110 may be referred to as a first tower, and the second discharge department 120 may be referred to as a second tower.

Hereinafter, for convenience of description, an orientation is given to the blower 1. It is assumed that the first discharge department 110 is disposed on the right side with respect to the blowing space Vb, and the second discharge department 120 is disposed on the left side with respect to the blowing space Vb (see an orientation of FIG. 2). That is, the first discharge department 110 and the second discharge department 120 may be disposed on the left and right with the blowing space Vb as the center. The first discharge department 110 and the second discharge department 120 may be spaced apart from each other in left and right sides (see the orientation in FIG. 2).

Accordingly, at least the front and rear sides of the blowing space Vb are open. In addition, preferably, in order to implement a rising wind by an air current converter 400 to be described later, the blowing space Vb may be open together with the upper side. For example, the overall shape of the discharge departments 110 and 120 may be formed in a U shape. Alternatively, for example, even when the overall shape of the discharge department 110 or 120 is O-shaped, an opening formed through the top of the discharge department 110 or 120 in an up-down direction may be provided.

Meanwhile, as described above, when the discharge departments 110 and 120 are formed in a "U" shape or a shape close to the "U" shape, the discharge departments 110 and 120 may include the following end portions.

The first discharge department 110 may include an upper end 111 as an upper end portion, a front end 112 as a front end portion, and a rear end 113 as a rear end portion. The second discharge department 120 may include an upper end 121 as an upper end portion, a front end 122 as a front end portion, and a rear end 123 as a rear end portion (see FIG. 1).

The front ends 112 and 122 and the rear ends 113 and 123 of the discharge departments 110 and 120 may become boundaries between an inner department and an outer department to be described later.

Figure 2:
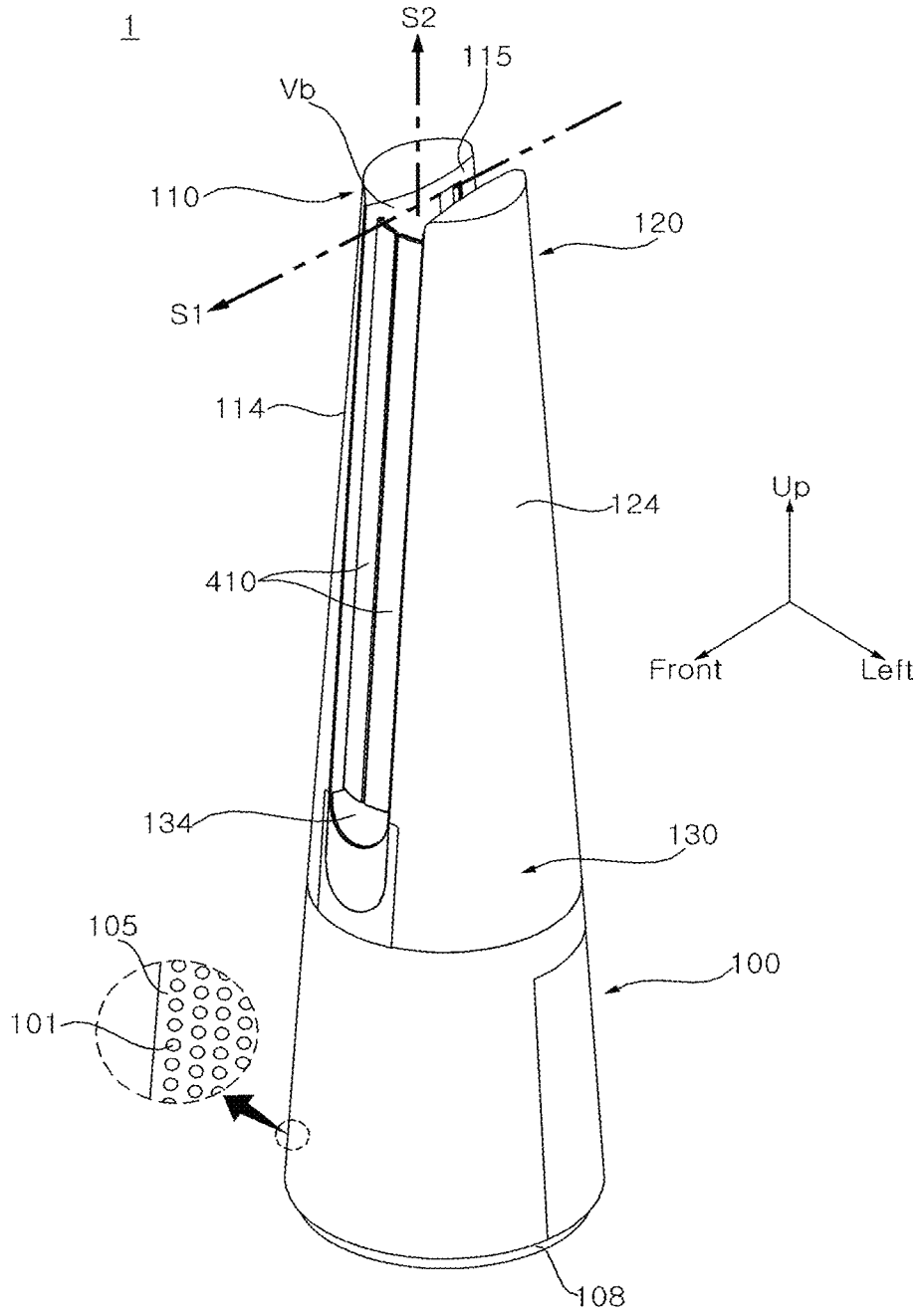
FIG. 2 is a perspective view of the blower in a state in which a guide board protrudes in FIG. 1.
Figure 3:
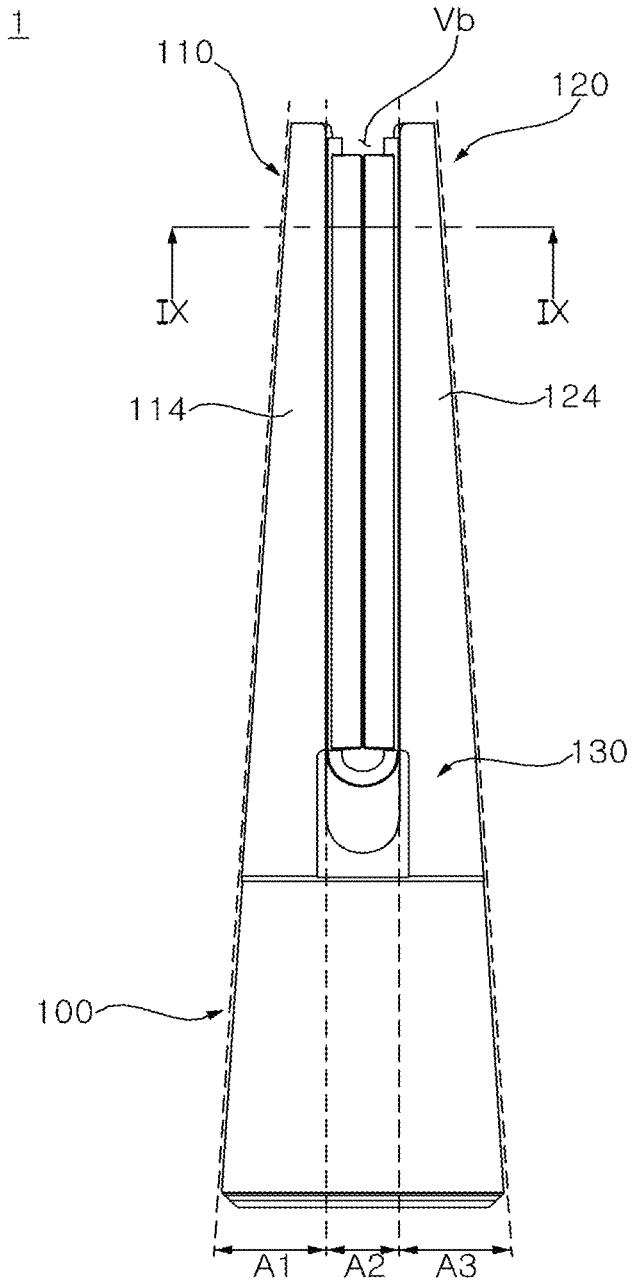
FIG. 3 is a front view of FIG. 2.
Figure 17:
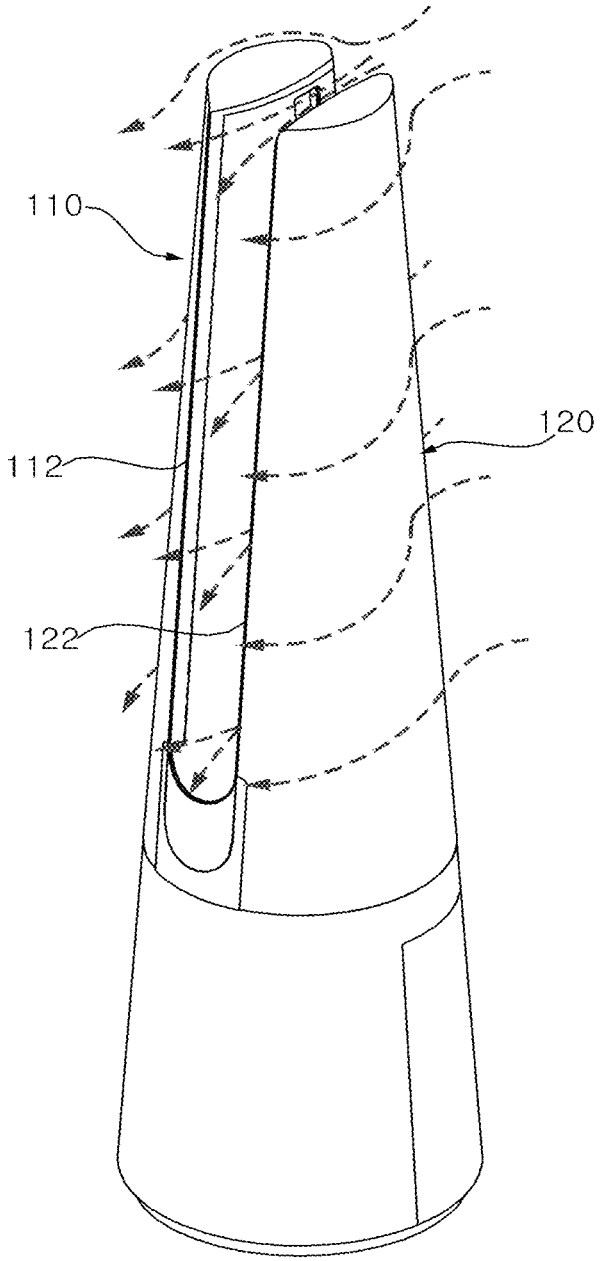
FIG. 17 is an air flow diagram when the blower implements forward wind according to an embodiment of the present disclosure.
Figure 18:
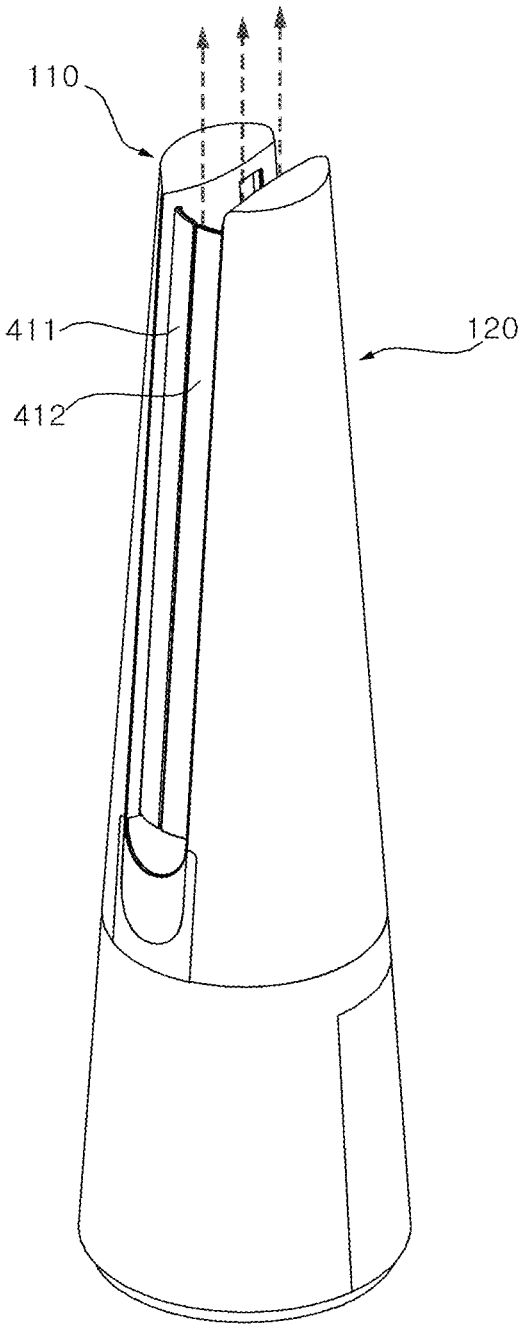
FIG. 18 is an air flow diagram when the blower implements an upward wind according to an embodiment of the present disclosure.

Referring to FIGS. 2, 17, and 18, the air discharge direction of the blower 1 may include a first air discharge direction S1 which is a horizontal direction crossing the blowing space Vb, and a second air discharge direction S2 which is a vertical direction crossing the blowing space Vb. Air flowing in the first air discharge direction S1 may be referred to as a horizontal airflow or forward wind, and air flowing in the second air discharge direction S2 may be referred to as an upward airflow or upward wind.

In this case, it may be understood that the horizontal air flow has a greater flow rate of air flowing in the horizontal direction rather than meaning that air flows only in the horizontal direction. Likewise, the upward airflow may be understood as having a higher flow rate of air flowing in an upward direction rather than meaning that air flows only in an upward direction. The upward airflow can suppress direct flow of discharged air to the user and actively circulates the indoor air.

In order to implement the second air discharge direction S2 without interference, the upper side of the blowing space Vb may be opened. For example, the upper end 111 of the first discharge department 110 and the upper end 121 of the second discharge department 120 may be spaced apart from each other.

In addition, in order to implement the first air discharge direction S1 without interference, the front and rear sides of the blowing space Vb may be opened. For example, the front end 112 of the first discharge department 110 and the front end 122 of the second discharge department 120 are spaced apart from each other, and the rear end 113 of the first discharge department 110 and the rear end 123 of the second discharge department 120 may also be spaced apart from each other.

The first discharge department 110 is disposed above the housing 160. The first discharge department 110 forms a space Vo1 communicating with the inside of the housing 160. The space vo1 may be referred to as a first discharge space Vo1. The first discharge department 110 has a periphery or the periphery and an upper surface to form an inner space, and a lower surface may be an open casing. In this case, the open lower surface of the first discharge department 110 may come into contact with the open upper surface of the housing 160. Accordingly, the first discharge space Vo1 and the inner space of the housing 160 may communicate with each other.

For example, the first discharge department 110 may be a rectangular parallelepiped casing with an open lower surface. Alternatively, for example, the first discharge department 110 may be a cylindrical casing with an open lower surface. Alternatively, for example, the first discharge department 110 may be a conical casing with an open lower surface. In addition to the above-described shapes, the shape of the first discharge department 110 may have any shape that can be easily modified by those skilled in the art. However, for convenience of description below, the first discharge department 110 will be described based on the case of a casing having a shape close to a truncated cone with an open lower surface, a narrower cross-sectional area toward the upper side, and a flat upper surface.

The first discharge department 110 has a first discharge port 117. For example, the first discharge port 117 may be formed by opening the periphery or upper surface of the first discharge department 110. Air introduced into the first discharge space Vo1 from the housing 160 may be discharged from the blower 1 through the first discharge port 117.

The first discharge department 110 extends upward. That is, the outer appearance of the first discharge department 110 may be formed long in the up-down direction. The first discharge port 117 may also be formed long in the up-down direction along the first discharge department 110. A length of the first discharge port 117 in the up-down direction may be close to a length of the first discharge department 110 in the up-down direction. The lower end of the first discharge port 117 may be formed close to the lower end of the first discharge department 110, and the upper end of the first discharge port 117 may be formed close to the upper end of the first discharge department 110. Accordingly, the blower 1 can provide an abundant discharge air volume while occupying a narrow plane area of the indoor space.

The second discharge department 120 is disposed above the housing 160. The second discharge department 120 forms a space Vo2 communicating with the inside of the housing 160. The space vo2 may be referred to as a second discharge space Vo2. The second discharge department 120 has a periphery or a periphery and an upper surface to form an inner space, and a lower surface may be an open casing. In this case, the open lower surface of the second discharge department 120 may come into contact with the open upper surface of the housing 160. Accordingly, the second discharge space Vo2 and the inner space of the housing 160 may communicate with each other.

For example, the second discharge department 120 may be a rectangular parallelepiped casing with an open lower surface. Alternatively, for example, the second discharge department 120 may be a cylindrical casing with an open lower surface. Alternatively, for example, the second discharge department 120 may be a conical casing with an open lower surface. In addition to the above-described shapes, the shape of the second discharge department 120 may have any shape that can be easily modified by those skilled in the art. However, for convenience of description below, the second discharge department 120 will be described based on the case of a casing having a shape close to a truncated cone with an open lower surface, a narrower cross-sectional area toward the upper side, and a flat upper surface.

The second discharge department 120 has a second discharge port 127. For example, the second discharge port 127 may be formed by opening the periphery or upper surface of the second discharge department 120. Air introduced into the second discharge space Vo2 from the housing 160 may be discharged from the blower 1 through the second discharge port 127.

The second discharge department 120 extends upward. That is, the outer appearance of the second discharge department 120 may be formed long in the up-down direction. The second discharge port 127 may also be formed long in the vertical direction along the second discharge department 120. A length of the second discharge port 127 in the up-down direction may be close to a length of the second discharge department 120 in the up-down direction. The lower end of the second discharge port 127 may be formed close to the lower end of the second discharge department 120, and the upper end of the second discharge port 127 may be formed close to the upper end of the second discharge department 120. Accordingly, the blower 1 can provide an abundant discharge air volume while occupying a narrow plane area of the indoor space.

Meanwhile, the position where the discharge port is disposed in the discharge departments 110 and 120 can be modified in various ways by those skilled in the art. For example, the discharge port may be disposed on the upper surfaces of the discharge departments 110 and 120. For example, the discharge port may be disposed on a surface (hereinafter referred to as, an outer department) other than the surface facing each other between the discharge departments 110 and 120. However, preferably, in order to maximize the performance of the blower 1 through the blowing space Vb and the Coanda effect in a structure in which the two discharge departments 110 and 120 face each other, the discharge port may be disposed on a surface (hereinafter, referred to as an inner department) where the two discharge departments 110 and 120 face each other. Hereinafter, for convenience of description, it will be described based on a case where the first discharge port 117 is disposed in the first inner department 115 of the first discharge department 110, and the second discharge port 127 is disposed in the second inner department 125 of the second discharge department 120.

Meanwhile, the space spaced apart between the first discharge department 110 and the second discharge department 120 may be referred to as the blowing space Vb in the sense that it is a space in which air discharged from the discharge port flows. The blowing space Vb may be formed between the first discharge department 110 and the second discharge department 120 facing each other. The outer surfaces of the first discharge department 110 and the second discharge department 120 may be understood as boundaries of the blowing space Vb.

The first discharge port 117 may be disposed toward the blowing space Vb. In addition, the second discharge port 127 may be disposed toward the blowing space Vb.

Air flowing in the first discharge space Vo1 may be discharged to the blowing space Vb through the first discharge port 117. Air flowing in the second discharge space Vo2 may be discharged to the blowing space Vb through the second discharge port 127.

Air discharged from the first discharge port 117 and the second discharge port 127 may flow to the user after being joined in the blowing space Vb. That is, the discharge air of the first discharge port 117 and the discharge air of the second discharge port 127 do not individually flow to the user, but the discharged air of the first discharge port 117 and the discharged air of the second discharge port 127 may be provided to the user after being joined in the blowing space Vb. The blowing space Vb may be used as a space in which discharged air is joined and mixed. Since the discharge air of the first discharge port 117 and the discharge air of the second discharge port 127 are joined in the blowing space Vb, the straightness of the discharge air can be improved.

Air discharged from the discharge port into the blowing space Vb may be discharged forward along the first inner department 115 and the second inner department 125 by the Coanda effect. The outer surface of the first inner department 115 and the outer surface of the second inner department 125 may act as Coanda surfaces to guide the air flowing through the blowing space Vb forward. That is, the air discharged from the discharge port can flow forward along the outer surface of the inner department by the Coanda effect.

As the discharge wind having a higher pressure and speed than the outside air is discharged to the open front of the blowing space Vb through the blowing space Vb, a negative pressure inside the blowing space Vb with respect to the rear of the blower 1 can be formed. Accordingly, air from the rear of the blower 1 may flow into the blowing space Vb. Air introduced into the blowing space Vb from the rear of the blower 1 may join the discharge wind. Accordingly, the air volume discharged from the blower 1 may further increase.

That is, as the discharge port discharges air toward the blowing space Vb, the air discharged from the first discharge port 117 and the second discharge port 127 are joined in the blowing space Vb and flow forward, the air at the rear of the blower 1 is drawn into the blowing space Vb by the pressure difference and flows forward, and thus, the air volume of the blower 1 may increase.

Due to the air flow in the blowing space Vb, air flow may also be generated around the outer department. The outer department may induce the Coanda effect on the surrounding air flow to guide the air flow to the front ends 112 and 122. That is, the outer surface of the first outer department 114 and the outer surface of the second outer department 124 may act as Coanda surfaces for the air on the side of the blower 1, and thus, the air on the side of the blower 1 may join the forward wind. Accordingly, the air volume discharged from the blower 1 may further increase.

The first discharge department 110 and the second discharge department 120 may be formed in a streamlined shape with respect to air discharge directions S1 and S2. For example, the first inner department 115 and the second inner department 125 may be convex in planar cross-section toward the blowing space Vb. For example, the first outer department 114 and the second outer department 124 may be convex in planar cross-section toward the left and right sides, respectively.

Meanwhile, the width of the blowing space Vb may refer to a separation distance between the two discharge departments 110 and 120 or a length of the blowing space Vb in the left-right direction. The depth of the blowing space Vb may refer to a length of the blowing space Vb in the front-rear direction. The height of the blowing space Vb may refer to the length of the blowing space Vb in the up-down direction (see the orientation in FIG. 2).

In the separation distance (that is, the width of the blowing space Vb) between the first inner department 115 and the second inner department 125, a shortest distance may be referred to as a shortest distance B0. The first and second discharge ports may be located on the rear side of the point at which the shortest distance B0 is formed.

The separation distance between the front end 112 of the first discharge department 110 and the front end 122 of the second discharge department 120 may be referred to as the first separation distance B1, and the separation distance between the rear end 113 of the first discharge department 110 and the rear end 123 of the second discharge department 120 may be referred to as the second separation distance B2.

B1 and B2 may be formed identically. Unlike the present embodiment, any one of B1 or B2 may be formed longer.

The first discharge port 117 and the second discharge port 127 may be disposed between B0 and B2. It is preferable that the first discharge port 117 and the second discharge port 127 are disposed closer to the rear end 113 of the first discharge department 110 and the rear end 123 of the second discharge department 120 than B0. As the discharge ports 117 and 127 are disposed closer to the rear ends 113 and 123, airflow control through the Coanda effect may be facilitated.

Meanwhile, in order to enhance the Coanda effect, the discharge port may be curved toward the front so that air discharged through the discharge port is discharged toward the front. In this regard, a detailed description of the shape of the discharge port will be described later.

The first discharge port 117 and the second discharge port 127 may be disposed in a region in which a blowing space Vb is formed in a vertical direction.

The lengths of the first discharge port 117 and the second discharge port 127 in the up-down direction may be longer than the width of the blowing space Vb. Accordingly, the discharge air of the first discharge port 117 and the discharge air of the second discharge port 127 can be induced to be joined smoothly in the blowing space Vb.

The first discharge department 110 and the second discharge department 120 may be symmetrical to each other based on the blowing space Vb. The first discharge port 117 and the second discharge port 127 may be symmetrical to each other based on the blowing space Vb. In contrast, the first discharge department 110 and the second discharge department 120 may be formed in an asymmetrical shape. However, it may be more advantageous to control the horizontal airflow and the ascending airflow when the first discharge department 110 and the second discharge department 120 are symmetrical with respect to the blowing space Vb.

Meanwhile, each of the two discharge departments 110 and 120 may be divided into manufacturing units as will be described later based on a blowing space Vb for assembly and manufacturing convenience.

The first discharge department 110 may be divided into a first inner department 115 which is a portion facing the blowing space Vb of the first discharge department 110, and a first outer department 114 which is a portion not facing the blowing space Vb. The first discharge department 110 may be formed by combining the first inner department 115 and the first outer department 114. The first inner department 115 and the first outer department 114 may form a continuous surface.

Each of the first inner department 115 and the first outer department 114 may be formed as a single member. However, as illustrated in the drawings, for convenience of manufacturing and assembly, the first inner department 115 may be formed by combining an outer sleeve 1150 disposed on the outside and an inner sleeve 115*i* disposed on the inside. Moreover, the first outer department 114 may be formed by combining an outer sleeve 114*o* disposed on the outside and an inner sleeve 114*i* disposed on the inside.

The second discharge department 120 may be divided into a second inner department 125 which is a portion facing the blowing space Vb of the second discharge department 120 and a second outer department 124 which is a portion not facing the blowing space Vb. The second discharge department 120 may be formed by combining the second inner department 125 and the second outer department 124. The second inner department 125 and the second outer department 124 may form a continuous surface.

The second inner department 125 and the second outer department 124 may each be formed as a single member. However, as illustrated in the drawing, for convenience of manufacturing and assembly, the second inner department 125 may be formed by combining an outer sleeve 125*o* disposed on the outside and an inner sleeve 125*i* disposed on the inside. In addition, the second outer department 124 may be formed by combining an outer sleeve 124*o* disposed on the outside and an inner sleeve 124*i* disposed on the inside (see FIGS. 8, 9, and 11).

The first outer department 114 of the first discharge department 110 and the second outer department 124 of the second discharge department 120 may be disposed in opposite directions. The first inner department 115 of the first discharge department 110 and the second inner department 125 of the second discharge department 120 may face each other.

Meanwhile, as described above, by manufacturing and assembling the discharge department by dividing the discharge department into an inner department and an outer department, the Coanda surface suitable for the flow around the inner department and the Coanda surface suitable for the flow around the outer department may be easier formed in appropriate shapes, respectively.

As described above, when the overall shape of the discharge departments 110 and 120 is "U", the distance (the width of the blowing space Vb) between the two discharge departments 110 and 120 excluding the portion of the bridge 134 may be formed to be narrower, distant, or constant from the upper end toward the bottom. For example, when the distance becomes narrower from the upper end to the bottom, the overall shape of the discharge departments 110 and 120 may be close to a "V" shape. For example, when the distance increases from the upper end to the bottom, the overall shape of the discharge departments 110 and 120 may be close to a shape obtained by rotating a "C" shape by 90 degrees in a counterclockwise direction. The wider side of the blowing space Vb may have a relatively lower flow rate than the narrower side. The reach distance of the discharge wind may vary according to the flow speed of the discharge wind.

In this way, the distance between the two discharge departments 110 and 120 excluding the portion of the bridge 134 may be variously modified by those skilled in the art in consideration of the reach distance of the discharge wind and the like. In the following description, for convenience, the description will be made based on the case where the width of the blowing space Vb is formed constant. In this case, the speed and reach of the discharge wind can be formed uniformly according to the height.

A width SL1 (that is, the depth of the blowing space Vb) of the blowing space Vb in the front-rear direction may be longer than a width SL2 (that is, the width of the blowing space Vb) of the blowing space Vb in the left-right direction (see FIGS. 8, 9, and 12).

Therefore, by forming the width SL1 of the blowing space Vb in the front-rear direction relatively long, it is possible to provide a sufficient Coanda surface for the blower 1 to discharge forward wind. By forming the width SL2 of the blowing space Vb in the left-right direction relatively short, it is possible to secure the wind pressure that the forward wind can reach far.

The first outer department 114 may be connected to the housing 160. The first outer department 114 may form a continuous surface with the upper end of the housing 160. The second outer department 124 may be connected to the housing 160. The lower ends of the first outer department 114 and the second outer department 124 may have the same shape as that of the upper end of the housing 160. The lower ends of the first and second outer departments 114 and 124 may form a continuous surface with the upper end of the housing 160. By connecting the outer portion of the blowing space Vb of the periphery of the discharge departments 110 and 120 with the lower housing 160, a portion of the loads of the discharge departments 110 and 120 is directly transferred to the housing 160 while the internal flow path of the housing 160 and the internal flow paths of the discharge departments 110 and 120 communicate with each other, and thus, the structural stability of the blower 1 can be improved.

In addition, the outer department of the discharge departments 110 and 120 forms a continuous surface with the housing 160. Accordingly, in the communication between the inner space of the housing 160 and the inner discharge spaces of the discharge departments 110 and 120, unnecessary flow resistance can be prevented by ensuring that they are connected smoothly without forming a step difference at the boundary of the flow path.

The lower portion of the side end of the first outer department 114 and the lower portion of the side end of the second outer department 124 may be connected to each other to form a continuous surface. The lower portion of the side end of the first outer department 114, the lower portion of the side end of the second outer department 124, and the bridge 134 together allow the first discharge department 110 and the second discharge department 120 to be connected.

Hereinafter, the bridge will be described (see FIGS. 1 to 7).

The first discharge department 110 and the second discharge department 120 may further include the bridge 134 that extends laterally and connects lower portions of the first discharge department 110 and the second discharge department 120 facing each other. The bridge 134 may connect the lower portion of the first inner department 115 and the lower portion of the second inner department 125. The bridge 134 may be understood as a portion of each of the discharge departments 110 and 120. The bridge 134 connects the lower portions of the first discharge department 110 and the second discharge department 120 to improve stiffness of the two spaced apart discharge departments 110 and 120 against an external force.

The upper surface of the bridge 134 provides a portion of the outer appearance of the blower 1 and may form a lower boundary surface of the blowing space Vb. The upper surface of the bridge 134 may be formed considering the flow in the blowing space Vb. The upper surface of the bridge 134, the first outer department 114, the second outer department 124, the first inner department 115, and the second inner department 125 may together form the outer appearances of the discharge departments 110 and 120.

The lower surface of the bridge 134 may form an inner surface of the blower 1, in particular, an upper boundary surface of the distribution space Vd. A portion of the air flowing in the distribution space Vd may be distributed to the first discharge space Vo1 and the second discharge space Vo2 by the lower surface of the bridge 134. The lower surface of the bridge 134 may be formed considering the flow in the distribution space Vd.

The shape of the bridge 134 may be a shape extending laterally to connect the first discharge department 110 and the second discharge department 120 spaced laterally apart. For example, the bridge 134 may have a shape which extends in a horizontal direction and includes one end forming a corner perpendicular to the first discharge department 110, and the other end forming a corner perpendicular to the second discharge department 120. Alternatively, for example, the bridge 134 has a "V" shape and may include one end forming a smooth continuous surface with the first discharge department 110, and the other end forming a smooth continuous surface with the second discharge department 120.

However, since the upper surface of the bridge 134 may affect the flow in the blowing space Vb and the lower surface of the bridge 134 may affect the distribution of the flow in the distribution space (Vd). Accordingly, preferably, the bridge 134 has a rounded "U" shape and may have one end forming a smooth continuous surface with the first discharge department 110 and the other end forming a smooth continuous surface with the second discharge department 120. That is, the bridge 134 may be concave downward.

In that the air that does not go straight through the pressurized space Vp to the discharge flow path collides with the bridge 134 and flows to the discharge flow path, by forming the shape of the bridge 134 as a curved surface recessed downward, the flow resistance due to collision with the bridge 134 can be reduced.

The bridge 134 may include a bridge cover 134*a*, a first bridge portion 134*b*1, a second bridge portion 134*b*2, a first insertion portion (or first insertion extension) 134*c*1, and a second insertion portion (or second insertion extension) 134*c*2 (see FIGS. 8 to 13).

The bridge cover 134*a* may be disposed on the outermost side of the bridge 134 to form the outer surface of the bridge 134. The bridge cover 134*a* may be manufactured as a separate member from the first inner department 115 and the second inner department 125 and assembled and fastened. The bridge cover 134*a* may connect a lower end 134*aa* of the outer sleeve 1150 of the first inner department 115 and a lower end 134*ab* of the outer sleeve 125*o* of the second inner department 125 in a continuous surface. The bridge cover 134*a* may have a round "U" shape.

A front end of the bridge cover 134*a* may be bent downward and extended to form a front surface 134*ac*. The front surface 134*ac* of the bridge cover 134*a* is made of a translucent material, so that a display can be displayed. The front surface 134*ac* of the bridge cover 134*a* may form a continuous surface with the first outer department 114 and the second outer department 124. The front surface 134*ac* of the bridge cover 134*a* may provide a periphery of the blower 1 together with the first outer department 114 and the second outer department 124. The front surface 134*ac* of the bridge cover 134*a* may be understood as a portion of the housing 160.

Meanwhile, in manufacturing the bridge 134, the bridge 134, which is a horizontal member, may be manufactured and assembled completely separately from the first and second discharge departments 110 and 120 extending vertically. However, since the portion of the bridge 134 is a portion on which stress is concentrated as the load and/or external force of the discharge departments 110 and 120 spaced apart from each other are transferred to the lower housing 160, preferably, at least portion of the bridge 134 is made integral with the first discharge department 110 and the second discharge department 120, so that the coupling strength of the first discharge department 110, the second discharge department 120, and the bridge 134 is improved.

For example, the bridge 134 may include a first bridge portion 134*b*1 that extends to be curved downwardly from the lower end 134*aa* of the inner sleeve 115*i* of the first inner department 115 toward the second inner department 125, and a second bridge portion 134*b*2 that extends to be curved downwardly from the lower end 134*ab* of the inner sleeve 125*i* of the second inner department 125 toward the first inner department 115. The first bridge portion 134*b*1 may be integrally formed with the inner sleeve 115*i* of the first inner department 115. The second bridge portion 134*b*2 may be integrally formed with the inner sleeve 125*i* of the second inner department 125. The overall shape of the first bridge portion 134*b*1 and the second bridge portion 134 may be a "U" shape.

Figure 11:
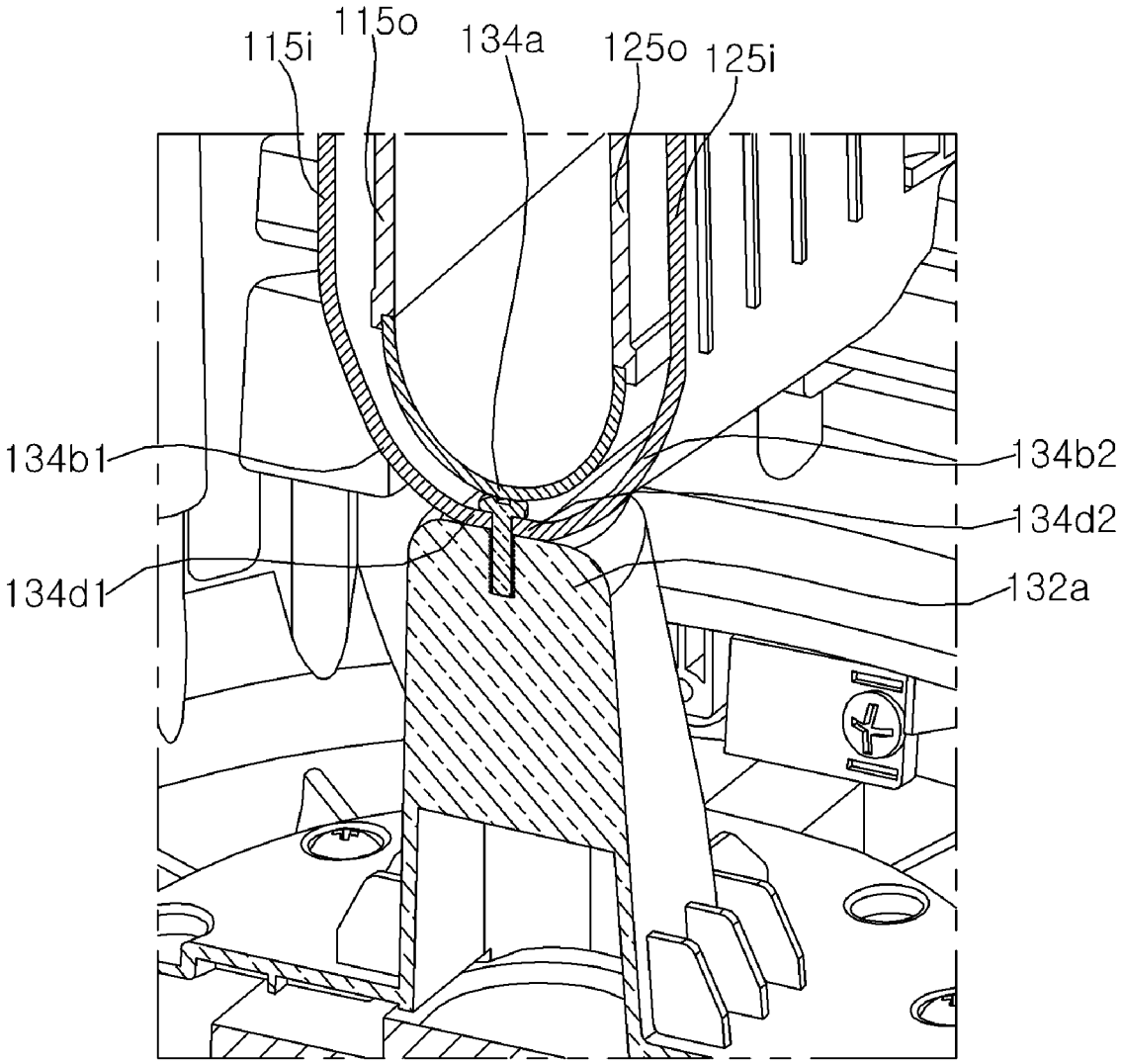
FIG. 11 is an enlarged perspective view of a cross section of a supporter according to still another embodiment of the present disclosure.

The first bridge portion 134*b*1 and the second bridge portion 134*b*2 may be connected to each other at the midpoint having a "U" shape to form a continuous surface (see FIG. 11). However, preferably, the first bridge portion 134*b*1 and the second bridge portion 134*b*2 may not be connected to each other at the lower end but may extend to be bent downwardly in a state of being apart from each other by a predetermined distance.

The first discharge department 110 (specifically, the first bridge portion 134*b*1) includes the first insertion portion 134*c*1 that extends downward from the lower portion of the first discharge department 110 (specifically, the first bridge portion 134*b*1) and is inserted into the protrusion 132*b* of the supporter 132 which will be described later. The second discharge department 120 (specifically, the second bridge portion 134*b*2) includes the second insertion portion 134*c*2 that extends downward from the lower portion of the second discharge department 120 (specifically, the first bridge portion 134*b*2) and is inserted into the protrusion 132*b* of the supporter 132 which will be described later. The first insertion portion 134*c*1 and the second insertion portion 134*c*2 are formed to be inserted into the protrusion 132*b* of the supporter 132 to be fitted, thereby facilitating fastening of the bridge 134 and the supporter 132.

The first insertion portion 134*c*1 and the second insertion portion 134*c*2 may come into surface contact with the inner surface of the protrusion 132*b* of the supporter 132. Since the bridge 134 includes the first insertion portion 134*c*1 and the second insertion portion 134*c*2, the connection strength between the bridge 134 and the supporter 132 can be improved by increasing a contact area with the supporter 132 (that is, the protrusion 132*b* of the supporter 132) to be described later.

Furthermore, the first insertion portion 134*c*1 may include extension surfaces 134*c*1*f* and 134*c*1*r* that are bent at the front and rear ends of the first insertion portion 134*c*1 and extend toward the second insertion portion 134*c*2. A planar cross-sectional shape of the first insertion portion 134*c*1 may be close to a "C" shape opening toward the second insertion portion 134*c*2. In addition, the second insertion portion 134*c*2 may include extension surfaces 134*c*2*f* and 134*c*2*r* that are bent at front and rear ends of the second insertion portion 134*c*2 and extend toward the first insertion portion 134*c*1. A planar cross-sectional shape of the second insertion portion 134*c*2 may be close to a "C" shape opening toward the first insertion portion 134*c*1.

The extension surface 134*c*1*f* of the front end of the first insertion portion 134*c*1 may come into surface contact with the extension surface 134*c*2*f* of the front end of the second insertion portion 134*c*2. The extension surface 134*c*2*r* of the rear end of the second insertion portion 134*c*2 may come into surface contact with the extension surface 134*c*1*r* of the rear end of the first insertion portion 134*c*1. That is, the first insertion portion 134*c*1 and the second insertion portion 134*c*2 may be force-fitted by being engaged with each other through the extension surface.

In addition, any one of the extension surface 134*c*1*f* of the front end of the first insertion portion 134*c*1 and the extension surface 134*c*2*f* of the front end of the second insertion portion 134*c*2 may come into surface contact with the inner surface of the protrusion 132*b* of the supporter 132. Any one of the extension surface 134*c*1*r* of the rear end of the first insertion portion 134*c*1 and the extension surface 134*c*2*r* of the rear end of the second insertion portion 134*c*2 may come into surface contact with the inner surface of the protrusion 132*b* of the supporter 132. That is, the first insertion portion 134*c*1, the second insertion portion 134*c*2, any one of the extension surface 134*c*1*f* of the front end of the first insertion portion 134*c*1 and the extension surface 134*c*2*f* of the front end of the second insertion portion 134*c*2, and any one of the extension surface 134*c*1*r* of the rear end of the first insertion portion 134*c*1 and the extension surface 134*c*2*r* of the rear end of the second insertion portion 134*c*2 may be formed to correspond to the inner periphery surface of the protrusion 132*b* of the supporter 132 and force-fitted to the protrusion 132*b* of the supporter 132.

For example, any one of the first insertion portion 134*c*1 (hereinafter, "insertion portion" may mean an insertion portion including an "extension surface") and the second insertion portion 134*c*2 is a protrusion 132*b* may be formed in a shape corresponding to the inner periphery of the protrusion 132*b*. Any one of the insertion portions may be engaged with the protrusion 132*b* in an interference fit manner. The other one of the first insertion portion 134*c*1 and the second insertion portion 134*c*2 may be formed in a shape corresponding to the inner periphery of the one. The other insertion portion may be engaged with the one insertion portion in an interference fit manner. In particular, in this case, by adopting a sequential interference fit manner in the fastening method between the discharge departments 110 and 120 and the supporter 132, the assemblability of the blower 1 can be improved. In addition, in performing bolting fastening, which will be described later, bolt holes can be aligned in a row primarily through an interference fit fastening, and thus, the assemblability can be further improved.

In this way, since the first insertion portion 134*c*1 and the second insertion portion 134*c*2 have extension surfaces, a contact area with the supporter 132 (that is, the protrusion 132*b* of the supporter 132) which will be described later is further widened, the fastening strength between the bridge 134 and the supporter 132 can be improved, and the fastening of the bridge 134 and the supporter 132 can be further facilitated.

Meanwhile, in order to improve the structural strength of the blower 1, the inner slit rib 115*i* of the first inner department 115 and the first insertion portion 134*c*1 may be formed as an integral member, and the inner sleeve 125*i* of the second inner department 125 and the second insertion portion 134*c*2 may be formed as an integral member.

The first insertion portion 134*c*1 and/or the second insertion portion 134*c*2 may further include a bolting surface for bolting to the supporter 132. At least one of the first insertion portion 134*c*1 and the second insertion portion 134*c*2 may include a bolting surface that extends laterally from the lower end and is in contact with the upper surface of the body 132*a*. The bolting surface and the upper surface of the body 132*a* may be bolted.

For example, each of the first insertion portion 134*c*1 and the second insertion portion 134*c*2 may have a bolting surface. The first insertion portion 134*c*1 may further include a first bolting surface 134*d*1 having a lower end that is bent toward the second insertion portion 134*c*2 and extends laterally. The second insertion portion 134*c*2 may further include a second bolting surface 134*d*2 having a lower end that is bent toward the first insertion portion 134*c*1 and extends laterally.

The first bolting surface 134*d*1 of the first insertion portion 134*c*1 and the second bolting surface 134*d*2 of the second insertion portion 134*c*2 may be vertically overlapped and bolted to the upper surface of the body 132*a* by a single bolt. That is, any one of the first bolting surface 134*d*1 and the second bolting surface 134*d*2 may be in surface contact with the upper surface of the body 132*a* inside the protrusion 132*b*. In this case, the other one of the first bolting surface 134*d*1 and the second bolting surface 134*d*2 is in surface contact with the upper surface of the one bolting surface, and thus, the first bolting surface 134*d*1 and the second bolting surface 134*d*2 may be overlapped vertically and then bolted by a single bolt. The supporter 132, the first insertion portion 134*c*1, and the second insertion portion 134*c*2 overlapped and stacked by only a single bolt can be fixed, and thus, the assemblability of the blower 1 can be improved.

Alternatively, the first bolting surface 134*d*1 and the second bolting surface 134*d*2 may extend toward each other at the same height in the up-down direction. In this case, a right portion on the flat cross-section of the single bolt passes through the first bolting surface 134*d*1, a left portion on planar cross-section of the single bolt penetrates the second bolting surface 134*d*2 and penetrates the upper surface of the body 132*a*, and thus, they can be connected to each other (see FIG. 11).

Meanwhile, the blower 1 according to the embodiment of the present disclosure may be extended in the up-down direction. Since the blower 1 is formed long in the up-down direction, it is possible to secure sufficient air volume while occupying a small area in the installation space (see FIGS. 1 to 3).

In the blower 1, the flat cross-sectional area may decrease toward the upper side. For example, the blower 1 may have a cone or truncated cone shape as a whole. By making the blower 1 narrower toward the upper side, the center of gravity of the blower 1 is lowered, and thus, the blower 1 is not easily knocked over by an external force. In addition, the internal flat cross-sectional area is formed to decrease as the distance from the blowing fan 102*a* increases, and thus, a uniform discharge flow rate can be secured over the entire discharge departments 110 and 120 formed long in the up-down direction.

Figure 19:
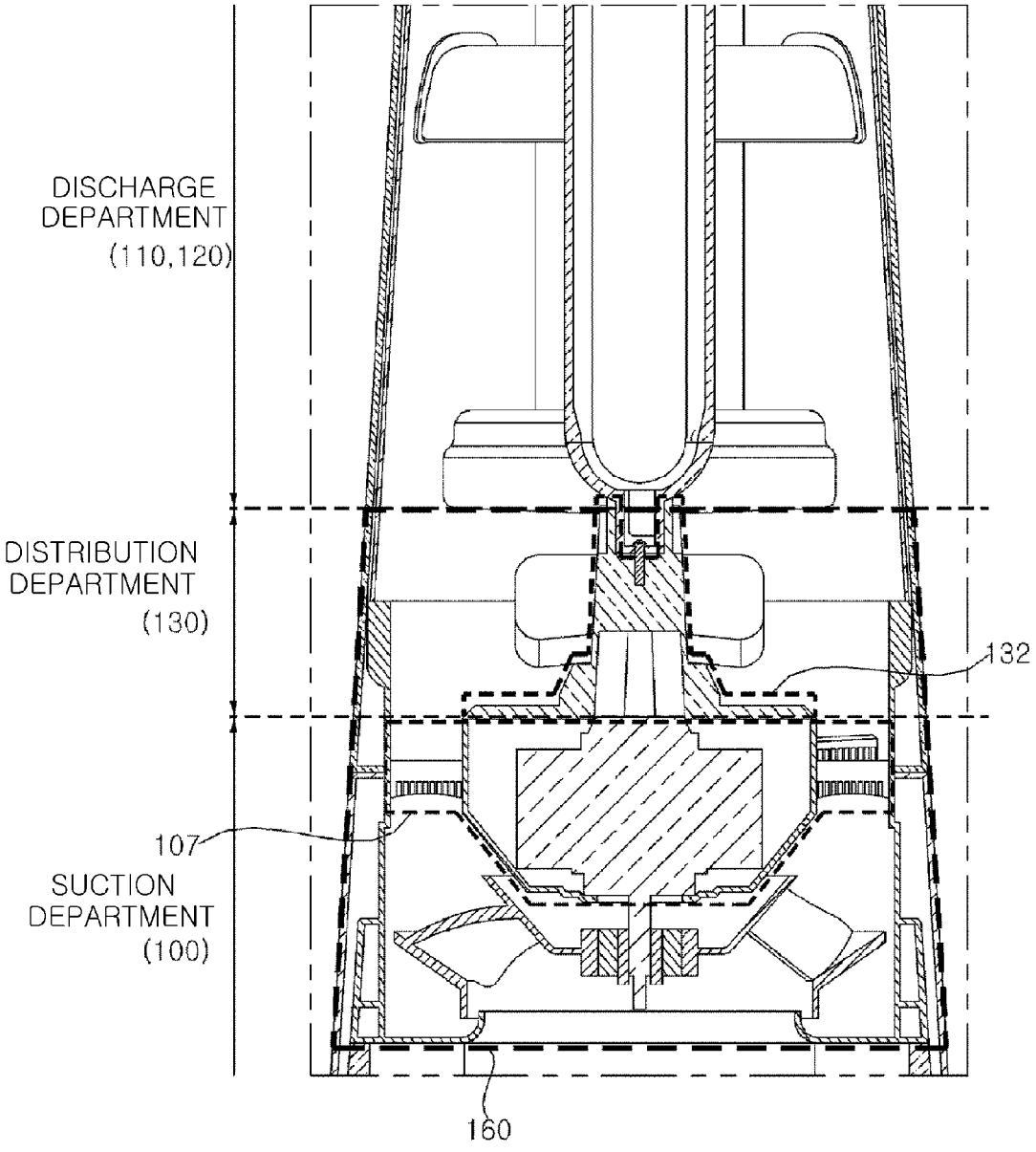
FIG. 19 is a diagram schematically illustrating each department of a blower, a housing, a supporter, and a ground according to an embodiment of the present disclosure.

Hereinafter, the ground and supporter will be described (see FIG. 19).

Since the blower 1 is formed long in the up-down direction, the blower 1 may be vulnerable to an external force applied to the blower 1 from the top, in particular, an external force applied in the lateral direction. Accordingly, it is necessary to provide a separate structure that properly transfers a load of the upper portion of the blower 1 to the lower portion.

Since at least some of the plurality of discharge departments 110 and 120 have a structure in which they are spaced apart from each other, they may be vulnerable to an external force applied to the spaced discharge departments 110 and 120, in particular, an external force applied in the lateral direction. Therefore, a separate structure supporting the spaced discharge departments 110 and 120 needs to be provided.

As the discharge departments 110 and 120 extends long in the up-down direction, the load or external force to be supported per unit area of the lower structures of the discharge departments 110 and 120 increases. Therefore, a separate structure supporting the discharge departments 110 and 120 extending in an up-down direction needs to be provided.

The supporter 132 and ground 107 disclosed in this description can meet these needs and improve the structural stability of the blower 1.

Hereinafter, the ground will be described with reference to FIGS. 4 to 9, 12, and 13 first.

The ground may be disposed inside the housing 160. The ground 107 is disposed above the blowing fan 102*a*. The ground 107 is disposed on the downstream side of the blowing fan 102*a*. At least a portion of the ground 107 is spaced downward from the discharge departments 110 and 120. At least a portion of the ground 107 is spaced downward from the first discharge department 110 and the second discharge department 120. Since the ground 107 is spaced downward from the discharge departments 110 and 120, the above-described distribution space Vd may be formed between the ground 107 and the discharge departments 110 and 120. A space from the upper side of the ground 107 to the lower sides of the discharge departments 110 and 120 may be referred to as the distribution space Vd.

The supporter 132 to be described later may be disposed above the ground 107. The ground 107 may be connected to the supporter 132. The ground 107 is connected to the housing 160. The ground 107 may transmit a load or an external force transmitted from the supporter 132 to the housing 160. That is, the ground 107 may function as a support structure together with the supporter 132 to be described later (see FIG. 19).

The ground 107 may mainly extend in the horizontal direction. That is, when the supporter 132 described later is a vertical member that mainly transfers loads in a vertical direction, the ground 107 may be understood as the horizontal member that mainly transfers loads in the horizontal direction.

Meanwhile, when the ground 107 is disposed in the downstream portion of the blowing fan 102*a*, the shape of the ground 107 needs to be determined from the viewpoint of providing a flow path. Specifically, in order for air to reach uniformly the entire discharge port in a structure in which the discharge port extends long in the vertical direction (in particular, in order for air to reach uniformly a portion of the discharge port that is far from the blowing fan 102*a*), first, it is necessary to change the direction of the airflow discharged from the blowing fan 102*a* to a upward wind above a certain level, and second, it is necessary to increase the pressure of the air discharged from the blowing fan 102*a* above a certain level. Accordingly, the ground 107 disposed on the downstream side of the blowing fan 102*a* may be formed to perform a function of narrowing the flow channel to pressurize the airflow and also converting the direction of the airflow upward.

That is, the ground 107 may function as a support structure and at the same time as a flow path forming structure forming the pressurized space Vp. For example, the ground 107 may be provided in a form including the hub 107*a* and the spoke 107*b*, which will be described later. The blowing fan 102*a* may be disposed below the hub 107*a*.

As described above, the spaced space (specifically, the hub 107*a* to be described later) between the inner periphery surface of the rim 107*c* and the ground 107 may be referred to as the pressurized space Vp. The pressurized space Vp may be understood as a space for pressurizing air by forming the flow path narrower than other portions in the blower 1. Specifically, the pressurized space Vp may refer to a space from the air discharge port 102*ab* of the blowing fan 102*a* to the upper end of the ground 107.

The pressurized space Vp may be understood as a space which pressurizes the air discharged from the blowing fan 102*a* so that the air is delivered to the end portions of the vertically long discharge departments 110 and 120, and thus, causes the blower 1 to uniformly discharge the air.

The hub 107*a* may be formed in a predetermined shape as will be described later in order to support the load of the supporter 132 and form the pressurized space Vp. The hub 107*a* may have a lower surface, an upper surface, and a periphery. For example, the hub 107*a* may have a bowl shape.

The hub may be spaced inwardly from the housing 160. The periphery of the hub 107*a* may face the inner surface of the housing 160. Since the hub 107*a* is spaced inwardly from the housing 160, it is possible to form a flow path through which air discharged from the blowing fan 102*a* flows therebetween, that is, the above-described pressurized space Vp.

A distance of the hub 107*a* spaced from the housing 160, that is, a flow path width of the pressurized space Vp (hereinafter, a "width of the pressurized space Vp" or a "flow path width of the pressurized space Vp" may refer to a width of a portion of the pressurized space Vp in which the spoke 107*b* is disposed, that is, a width of a downstream portion of the pressurized space Vp in planar cross-section) may be formed relatively smaller than the flow path width of the distribution space Vd above the ground 107.

However, as the volume of the hub 107*a* increases, the function of the hub 107*a* as a support structure may be strengthened. However, since the width of the flow path of the pressurized space Vp becomes too narrow and the air flow may decrease, the hub 107*a* needs to be of an appropriate size as will be described later.

Meanwhile, the hub 107*a* spaced apart from the housing 160 may be connected to or fixed to the housing 160 by the spoke 107*b* to be described later.

The periphery of the bowl-shaped hub may be divided into a vertical upper portion 107*aa* and an inwardly inclined lower portion 107*ab*. The inclined lower portion 107*ab* may be formed so that the lower end is located on the same horizontal line as or close to the air discharge port 102*ab* of the blowing fan 102*a*.

The spoke 107*b* to be described later may be connected to the vertical upper portion 107*aa*. A length of the vertical upper portion 107*aa* in the up-down direction may be determined to secure a sufficient length of the spoke 107*b* in the up-down direction for structural strength and to enable sufficient flow compression. For example, the length of the vertical upper portion 107*aa* in the up-down direction may be a length of 70% or more a horizontal distance from the vertical upper portion 107*aa* to the housing 160 (or the rim 107*c*), that is, the width of the pressing space Vp.

A size of the vertical upper portion 107*aa* in planar cross-section may be formed so that the width of the pressurized space Vp is narrowed to about 30% to 70% from the width (or the distance between the upper shroud 102*ac* and the lower shroud 102*ac*) of the blades 102*ad* of the blowing fan 102*a*.

The inclined lower portion 107*ab* may guide air discharged from the blowing fan 102*a* upward through the inclined portion. The inclination of the inclined lower portion 107*ab* may be the same as an inclination degree of the shroud 102*ac* and blades 102*ad* of the blowing fan 102*a*.

The length of the periphery in the up-down direction, that is, the length of the hub 107*a* in the up-down direction may be set so that the length of the pressurized space Vp in the up-down direction corresponds to the length of the blowing fan 102*a* in the up-down direction.

A portion of the inclined lower portion 107*ab* may overlap the upper shroud 102*ac* of the blowing fan 102*a* in the up-down direction in consideration of space efficiency.

The periphery of the hub 107*a* may have a shape corresponding to the inner surface of the housing 160. For example, when the inner surface of the housing 160 is circular in planar cross-section, the periphery of the hub 107*a* may be circular having a radius smaller than that of the inner surface of the housing 160 in planar cross-section. Accordingly, it is possible to form a flow path having a uniform width about the rotating shaft of the blowing fan 102*a*.

The periphery (or peripheral surface) of the hub 107*a* may form a smooth continuous surface in consideration of flow.

A lower end of the vertical upper portion 107*aa* and an upper end of the inclined lower portion 107*ab* of the periphery may be connected to form a smooth continuous surface.

The supporter 132 may be disposed above the hub 107*a*. An upper surface of the hub 107*a* and a lower surface of the supporter 132 may be connected. The upper surface of the hub 107*a* may be connected to an extension portion 132*c* of a supporter 132 to be described later. The hub 107*a* may receive a load or an external force from the supporter 132. Alternatively, the hub 107*a* may fix the supporter 132 from an external force. The upper surface of the hub 107*a* may have a shape corresponding to the lower surface of the supporter 132. The upper surface of the hub 107*a* may have a flat plate shape. Alternatively, as will be described later, when the fan motor 102*b* is accommodated inside the hub 107*a*, the upper surface of the hub 107*a* may be open upward.

The spoke 107*b* may connect the hub 107*a* and the housing 160 (or the rim 107*c*). The spoke 107*b* may be a member extending in the horizontal direction. The spoke 107*b* may be a member extending in the radial direction. The spoke 107*b* may be a plate-shaped member arranged on a plane defined by the up-down direction and the radial directions. The spoke 107*b* may receive a load from the hub 107*a* and transmit the load to the housing 160. The spoke 107*b* may fix the hub 107*a* to the housing 160.

A radial length of the spoke 107*b* may be equal to a radially separation distance between the hub 107*a* and the housing 160 (or rim 107*c*). The length of the spoke 107*b* in the up-down direction may be determined to such an extent as to secure sufficient structural strength as a support structure and sufficient guide area to guide the air discharged from the blowing fan 102*a* upward.

A plurality of spokes 107*b* may be arranged along the outer periphery of the hub 107*a* and the inner periphery of the housing 160 (briefly, this may be referred to as a "rotational direction"). Air discharged from the blowing fan 102*a* may flow between the plurality of spokes 107*b* spaced apart from each other in the rotational direction. The number of spokes 107*b* and the thickness of the spokes 107*b* in the rotational direction may be formed to an appropriate thickness in consideration of the need to secure a flow path and the support strength of the ground 107.

The spoke 107*b* may be disposed in the space (that is, the pressurized space Vp) between the hub 107*a* and the rim 107*c* to guide the flowing air upward. The spokes 107*b* can function as vanes to reduce a radial component and enhance an upward component in the air flow. The spoke 107*b* may have a curved shape having an inclination in the rotational direction of the blowing fan 102*a*. The spoke 107*b* may be formed in an airfoil shape in consideration of the flow of air. The spoke 107*b* may be disposed at a downstream end of hub 107*a*. The shape of the spoke 107*b* for guiding the air upward can be understood as the shape of a general diffuser disposed in the blower 1.

The spoke may be formed in an arcuate shape when viewed from the rotational direction. That is, the lower end portion of the spoke 107*b* may be formed in an "n" shape to be recessed upward. It is known that the arcuate structure can improve strength of a member by allowing an external force applied to the structure from the upper side to be transmitted only in the form of a compressive force to a local portion of the structure, and generally utilizing the property of a member that is stronger against compressive force than tensile force. Accordingly, it is possible to more firmly resist the load or external force applied from the upper side.

Therefore, as described above, since the ground 107 includes the hub 107*a* and the spokes 107*b*, the ground 107 transfers the load received from the supporter 132 to the housing 160 while the ground 107 functions as a diffuser that improves the blowing performance of the blower 1, and thus, it is possible to improve the flow efficiency and space efficiency of the blower 1.

As long as the ground 107 can be formed to transfer the load received from the supporter 132 to the housing 160 and form a flow path through which the air discharged from the blowing fan 102*a* can pass, unlike the above, the ground 107 may have any shape. For example, the ground 107 may have a grill shape that extends laterally.

Unlike the above, the rim 107*c* may also be understood as a portion of the ground 107. That is, the ground 107 may be a concept that further includes the rim 107*c* spaced apart from the hub 107*a* and connected to the housing 160.

In this case, the spoke 107*b* may connect the hub 107*a* and the rim 107*c*. Accordingly, the load transmitted from the supporter 132 to the hub 107*a* may be transmitted to the rim 107*c* and the housing 160 through the spokes 107*b*. In addition, the supporter 132 and the hub 107*a* may be fixed to the housing 160 through the rim 107*c* and the spoke 107*b*.

The rim 107*c*, the spoke 107*b*, and the hub 107*a* may be integrally formed. In this case, a diffuser-combining ground 107 including the rim 107*c*, the hub 107*a*, and the spoke 107*b* is separately manufactured and then simply fastened to the housing 160, and thus, manufacturability and assembly convenience of the blower 1 can be improved. That is, in the process of manufacturing the blower 1, the manufacturing and assembly of the hub 107*a*, the spoke 107*b*, and the rim 107*c* can be separated from the manufacturing and assembly of other portions and performed separately, and thus, the manufacturability and assembly convenience of the blower 1 can be improved.

Description of the shape and function of the rim 107*c* may be the same as described above, and thus, the same description will be omitted.

Meanwhile, the hub 107*a* may have a hollow 132*e* formed therein. A fan motor 102*b* providing a driving force to the fan may be disposed inside the hub 107*a*. That is, the hub 107*a* may function as a load support structure and a diffuser, and may also function as a motor housing 160. The hub 107*a* may have a shape surrounding the fan motor 102*b*. The hub 107*a* may form an inner space through a lower surface, an upper surface, and a periphery.

As described above, when the hub 107*a* is formed in a bowl shape, a bulky portion of the fan motor 102*b* may be mainly disposed inside the vertical upper portion 107*aa* of the peripheral surface, and a portion having a small volume of the fan motor 102*b* and/or a motor shaft 102*ba* may be mainly disposed inside the inclined lower portion 107*ab* of the periphery surface.

At least a portion of the upper surface of the hub 107*a* may be opened to avoid interference with the fan motor 102*b* accommodated therein. In this case, the upper surface around the hub 107*a* may support the supporter 132. At least a portion of the lower surface of the hub 107*a* may be opened so that the motor shaft 102*ba* of the fan motor 102*b* accommodated therein passes therethrough. The motor shaft 102*ba* of the fan motor 102*b* may be connected to the blowing fan 102*a* by passing through the open lower portion of the hub 107*a*. The fan motor 102*b* may provide a driving force to the blowing fan 102*a*.

The space efficiency of the blower 1 can be further improved by using the inner space of the hub 107*a* as the housing 160 of the fan motor 102*b*.

Next, the supporter will be described with reference to FIGS. 4 to 13.

The supporter 132 may be disposed above the ground 107, that is, in the distribution space Vd. In this case, it is necessary to determine the shape and arrangement of the supporter 132 in an appropriate form that meets the function of the distribution space Vd which is the pressure buffer zone while stably supporting the load. Hereinafter, the supporter 132 will be described with reference to the accompanying drawings (particularly, FIGS. 8 to 13).

The supporter extends upward from the ground 107 to support the plurality of discharge departments 110 and 120. For example, the supporter 132 extends upward from the ground 107 to support the first discharge department 110 and the second discharge department 120. The supporter 132 may be supported by the ground 107.

An upper portion of the supporter 132 may be connected to the first discharge department 110 and/or the second discharge department 120. A lower portion of the supporter 132 may be connected to the ground 107. Accordingly, the supporter 132 may connect the discharge departments 110 and 120 and the ground 107. In this case, the connection may include a case of being connected indirectly with another member therebetween, in addition to a case of being directly connected.

The supporter 132 may transfer the loads of the discharge departments 110 and 120 to the ground 107. The supporter 132 may transmit an external force applied to the discharge departments 110 and 120 to the ground 107. The supporter 132 may fix the discharge departments 110 and 120 against an external force applied to the discharge departments 110 and 120 (see FIG. 19).

In this case, as described above, when the outer departments of the discharge departments 110 and 120 are directly connected to the housing 160, a portion of the load of each of the discharge departments 110 and 120 is directly transmitted to the housing 160 through the outer department and the remaining portion thereof may be transmitted to the housing 160 through the supporter 132 and the ground 107.

The supporter 132 may be formed long in the up-down direction. The supporter 132 may extend upward from the ground 107. The supporter 132 may mainly extend in the up-down direction. The supporter 132 may be a vertical member that transmits the load and/or the force mainly in the up-down direction.

The supporter 132 may be spaced apart from the housing 160 inwardly. A separation distance Wd between the supporter 132 and the housing 160 (or the rim 107*c*) may be greater than a separation distance (Wp) between the hub 107*a* and the housing 160 (or the rim 107*c*) described above. That is, the supporter 132 may be formed such that the flow path width Wd of the distribution space Vd is greater than the flow path width Wp of the pressurized space Vp (see FIGS. 8 and 9).

Even when the supporter 132 is disposed in the distribution space Vd, which is a space that buffers the pressure difference between the diffuser pressurization space Vp and the discharge space, the function of the distribution space Vd can be preserved by the supporter 132 making the flow path width of the distribution space Vd wider than the flow path width of the pressurized space Vp.

As described above, the upper portion of the supporter 132 may be connected to the first discharge department 110 and/or the second discharge department 120. Specifically, the supporter 132 may be connected to the first inner department 115 and/or the second inner department 125. Specifically, the supporter 132 may be connected to the bridge 134. The supporter 132 is connected to the vicinity of the center of gravity of the first discharge department 110 and the second discharge department 120 to support the discharge departments 110 and 120, thereby improving the structural stability of the blower 1.

The supporter 132 may be connected to a portion of the first discharge department 110 and the second discharge department 120 corresponding to the blowing space Vb in the up-down direction. The supporter 132 may be connected to the lower surface of the bridge 134. Therefore, the lower portion of the spaced gap between the first discharge department 110 and the second discharge department 120 is connected to the bridge 134 extending laterally, the supporter 132 is connected to the lower surface of the bridge 134, and thus, the loads of the discharge departments 110 and 120 may be evenly transferred to the supporter 132.

The supporter 132 may be connected to the vicinity of the center of the lower surface of the bridge 134. The structural stability of the blower 1 can be further improved by the supporter 132 supporting the center of gravity of the bridge 134.

The bridge may be bolted to the upper surface of the supporter 132 (see FIG. 11). The bridge 134 may be fixed to the supporter 132 by bolting. Unlike this, a connection method in which the protrusion 132*b* is formed on the upper surface of the supporter 132 and the bridge 134 is inserted into the protrusion 132*b* will be described later in the description of the protrusion 132*b*.

The supporter 132 may be disposed in a portion corresponding to the central portion of the ground 107 in planar cross-section. Accordingly, when the ground 107 supports the supporter 132, it is possible to prevent biased transfer of a load or the like to a specific portion of the ground 107.

The supporter 132 may be disposed in a portion vertically corresponding to the blowing space Vb in the inner space of the housing 160. For example, in a region A1 vertically corresponding to the first discharge department 110, a region A2 vertically corresponding to the blowing space Vb, and a region A3 vertically corresponding to the second discharge department, the supporter 132 may be disposed in the region A2 vertically corresponding to the blowing space Vb (see FIG. 3).

It can be understood that most of the air that is pressurized and discharged upward from the blowing fan 102*a* travels straight upward. This characteristic can be briefly referred to as the straightness of air. Therefore, by disposing the supporter 132 in a portion other than a section where the air discharged from the blowing fan 102*a* goes straight to the discharge spaces Vo1 and Vo2, the flow resistance caused by the supporter 132 can be minimized. Furthermore, in the air discharged from the blowing fan 102*a*, air and/or vortexes that do not travel in a straight line may be guided to the discharge spaces Vo1 and Vo2 by the supporter 132.

As described above, the first discharge department 110 and the second discharge department 120 may be disposed on the left and right sides of the blowing space Vb, and a width SL1 of the blowing space Vb in the front-rear direction may be longer than a width SL2 of the blowing space Vb in the left-right direction. Correspondingly, the length L1 of the supporter 132 in the front-rear direction may be longer than the length L2 in the left-right direction (see FIGS. 8 and 12).

Therefore, when the blowing space Vb is formed long in the front-rear direction in order to enhance the air volume of the blower 1 by forming a long Coanda surface, correspondingly, the discharge departments 110 and 120 can be stably supported by forming the supporter 132 long in the front-rear direction.

Meanwhile, the supporter may include the extension portion 132*c* that widens the area connected to the ground 107, the body 132*a* that is a vertical member extending in the up-down direction, and/or the protrusion 132*b* that widens the area connected to the bridge 134. For example, the supporter 132 may be formed of only the body 132*a*. For example, the supporter 132 may be formed with only the extension portion 132*c* and the body 132*a*. For example, the supporter 132 may be formed with only the body 132*a* and the protrusion 132*b*. For example, the supporter 132 may include all the extension portion 132*c*, the body 132*a*, and the protrusion 132*b*. Hereinafter, each portion that may constitute the supporter 132 will be described in detail.

The body 132*a* may extend in the up-down direction. The body 132*a* may be understood as a vertical member. The body 132*a* may transmit the loads of the discharge departments 110 and 120 to the ground 107. The body 132*a* may transmit an external force applied to the discharge departments 110 and 120 to the ground 107. The body 132*a* may fix the discharge departments 110 and 120 to the ground 107 against an external force applied to the discharge departments 110 and 120.

The body 132*a* may have a pillar shape. The body 132*a* may include a peripheral surface having a height, an upper surface, and a lower surface. The height of the body 132*a* may be the same as the length of the distribution space Vd in the up-down direction. The height of the body 132*a* may be equal to the separation distance between the ground 107 and the discharge departments 110 and 120.

The inside of the body 132*a* is filled with a member forming the outer surface of the body 132*a* to have a strong strength. However, the hollow 132*e* may be formed inside the body 132*a* if necessary. The hollow 132*e* inside the body 132*a* will be described later.

The body 132*a* may occupy most of the entire volume of the supporter 132. In this description, a description of the arrangement and shape of the supporter 132 may be understood as a description of the arrangement and shape of the body 132*a*.

Meanwhile, the blower 1 may further include a structure that penetrates into the inner space of the blower 1 to add a predetermined function to the blower 1. In this case, the supporter 132 may form an inclination corresponding to the intrusive structure. Specifically, the body 132*a* may form an inclination to secure a sufficient flow path width corresponding to the intrusive structure (see FIG. 12).

For example, the blower 1 is disposed in a portion of the housing 160 having a height corresponding to the supporter 132, and may further include a first structure (or first protrusion) 500 that protrudes into the housing 160 by a predetermined first distance G1 (see FIG. 12). For example, the first structure 500 may be a handle that allows a user to easily carry the blower 1 by putting their hand there. In general, the handle is formed by penetrating into the inner space of the blower 1 so that the user's finger is inserted to hook the blower 1.

In this case, the supporter 132 may include a first surface 132*aa* facing the first structure 500. The first surface 132*aa* may be inclined at a predetermined first angle s1 in a direction in which the first structure 500 protrudes. The first surface may be understood as a surface facing the first structure 500 of the outer surface of the body 132*a*.

The blower 1 may further include a second structure (or second protrusion) 510. The second structure 510 is disposed in a portion of the housing 160 having a height corresponding to the supporter 132, and may protrude into the housing 160 by a second distance G2 smaller than the first distance G1. For example, the second structure 510 may be a display unit that visually provides an operating state and an operation manual of the blower 1 to the user. In general, since the display unit is formed so as not to protrude outward from the outer surface of the blower 1 in consideration of the aesthetics of the blower 1, related parts are formed to penetrate into the inner space of the blower 1.

In this case, the supporter 132 may include a second surface 132*ab* facing the second structure 510. The second surface 132*ab* may be inclined at a second angle s2 smaller than the first angle s1 in the direction in which the second structure 510 protrudes. The second surface may also be understood as a surface facing the second structure 510 of the outer surface of the body 132*a*.

Therefore, even when the structure for adding a function to the blower 1 penetrates into the distribution space Vd, the flow path width of the distribution space Vd can be sufficiently secured by forming the supporter 132 inclined in response to the structure.

In addition, a magnitude relationship between the first angle s1 which is the inclination angle of the first surface and the second angle s2 which is the inclination angle of the second surface is formed corresponding to a magnitude relationship between the first distance G1 where the first structure 500 protrudes and the second distance G2 where the second structure 510 protrudes, it is possible to prevent a problem in which the supporter 132 is excessively thin and the strength of the member is weakened.

Meanwhile, a technical idea of the present disclosure is not limited by the specific form and function of the first structure 500 and the second structure 510. In addition, the number of structures is only exemplified by two for convenience of description, and the technical idea of the present disclosure is not limited to the number of structures.

The hollow 132*e* may be formed inside the lower portion of the supporter 132. The lower inner space of the body 132*a* may be formed as the hollow 132*e*. However, the size or shape of the hollow 132*e* should be determined within a level that does not lower the structural strength of the supporter 132 unnecessarily. For example, when the rib connecting the extension portion 132*c* and the body 132*a* and the rib connecting the body 132*a* and the protrusion 132*b* are sufficiently provided, the hollow 132*e* may be formed to have a size close to 50% of the size of the body 132*a*.

Therefore, when the lower portion of the supporter 132 has a relatively flat cross-sectional area wider than the upper portion to secure the structural stability, the lower portion inside the supporter 132 is formed as a hollow 132*e* to reduce material costs. Moreover, in a case where the ground 107 functions as the motor housing 160, even when the motor protrudes upward from the upper surface of the ground 107, the supporter 132 may be placed without interference.

The protrusion 132*b* may be disposed on the upper side of the body 132*a*. The protrusion 132*b* may extend upward from the body 132*a*. The protrusion 132*b* may extend upward from the upper surface of the body 132*a*. The protrusion 132*b* may form a periphery along the periphery of the upper surface of the body 132*a*. The first discharge department 110 and the second discharge department 120 may be connected to the supporter 132 inside the periphery formed by the protrusion 132*b*. Specifically, the above-described first insertion portion 134*c*1 of the first discharge department 110 and the above-described second insertion portion 134*c*2 of the second discharge department 120 may be inserted into the protrusion 132*b*. The first insertion portion 134*c*1 and the second insertion portion 134*c*2 may be in surface contact with the inner surface of the protrusion 132*b*. Since descriptions of the first insertion portion 134*c*1, the second insertion portion 134*c*2, and the bolting surface are the same as those described above, the same descriptions are omitted.

In this way, the protrusion 132*b* can increase the contact area between the discharge departments 110 and 120 and the supporter 132 to improve the coupling strength between the discharge departments 110 and 120 and the supporter 132. Specifically, the two spaced apart discharge departments 110 and 120 are particularly vulnerable to an external force (retracting or spreading force) in the lateral direction. Therefore, the protrusion (132*b*) forming a lateral periphery at the connection portion of the supporter 132 and the discharge departments 110 and 120 and the insertion portion inserted into the protrusion 132*b* are provided, the contact area in the lateral direction between the supporter 132 and the discharge departments 110 and 120 is widened, and thus, it is possible to improve the structural stability of the blower 1.

The extension portion 132*c* may be disposed in the lower portion of the body 132*a*. The extension portion 132*c* may extend laterally from the lower portion of the body 132*a*. The extension portion 132*c* extending from the body 132*a* may be connected to the ground 107. The extension portion 132*c* may be connected to an upper portion of the hub 107*a*. An upper surface of the hub 107*a* and a lower surface of the extension portion 132*c* may be formed to correspond to each other. A peripheral portion of the extension portion 132*c* may be connected to a peripheral portion of an upper portion of the hub 107*a*. For example, when the extension portion 132*c* is circular in planar cross-section, the upper periphery of the hub 107*a* may also be circular with the same diameter in a planar cross-sectional view.

By providing the extension portion 132*c*, the load or external force transmitted from the body 132*a* can be evenly distributed over the entire surface area of the ground 107 in planar cross-section, thereby improving the structural rigidity of the blower 1.

The lower surface of the body 132*a* and the extension portion 132*c* may be connected to the ground 107 together. Alternatively, as the hollow 132*e* is formed in the lower portion of the body 132*a*, only the extension portion 132*c* may be connected to the ground 107.

A thickness T1 of the extension portion 132*c* in the up-down direction may be smaller than a width T2 of the spoke 107*b* in the up-down direction (see FIG. 12). Accordingly, since the supporter 132 is provided, the thickness of the extension portion 132*c*, which is a portion connected to the ground 107, is formed relatively thin to sufficiently secure the internal flow path.

Meanwhile, in the supporter 132, a flat cross-sectional area may decrease toward the upper side. For example, when the supporter 132 is sequentially provided with the extension portion 132*c*, the body 132*a*, and the protrusion 132*b* from the bottom to the top, the flat cross-sectional area of the extension portion 132*c* may be wider than the flat cross-sectional area of the body 132*a*, and the flat cross-sectional area of the body 132*a* may be wider than the flat cross-sectional area of the protrusion 132*b*. The flat cross-sectional area of the body 132*a* may decrease toward the upper side. The flat cross-sectional area of the extension portion 132*c* may decrease toward the upper side. In addition, the flat cross-sectional area of the protrusion 132*b* may decrease toward the upper side (see FIG. 8).

By forming the flat cross-sectional area narrower for a portion of the supporter 132 closer to the discharge flow path, even when the supporter 132 is provided closer to the discharge flow path, the distribution of flow to each discharge flow path can be smoothly performed. Specifically, since the passage width of the distribution space Vd gradually widens as it approaches the discharge space, it is possible to gradually overcome the pressure difference between the pressurized space Vp and the discharge space can be gradual, and airflow can be smoothly distributed to each discharge flow path while preventing turbulence.

The supporter 132 may further include a rib reinforcing a portion where a step difference is formed.

Specifically, the supporter 132 may further include a first rib 132*d*1 connecting the protrusion 132*b* and the body 132*a*. For example, the first rib 132*d*1 may connect the upper surface of the body 132*a* and the outer surface of the protrusion 132*b*. The first rib 132*d*1 may be a plate-shaped member. A plurality of first ribs 132*d*1 may be disposed along the periphery of the outer surface of the protrusion 132*b*. The plurality of first ribs 132*d*1 may be spaced apart at equal intervals along the outer periphery of the protrusion 132*b*.

Specifically, the supporter 132 may further include a second rib 132*d*2 connecting the body 132*a* and the extension portion 132*c*. For example, the second rib 132*d*2 may connect a side surface of the body 132*a* and an upper surface of the extension portion 132*c*. The second rib 132*d*2 may be a plate-shaped member. A plurality of second ribs 132*d*2 may be disposed along the periphery of the side surface of the body 132*a*. The plurality of second ribs 132*d*2 may be spaced apart from each other at equal intervals along the periphery of the side surface of the body 132*a*.

Since the step difference generated by differentiating the flat cross-sectional area of each portion of the supporter 132 according to the height may be vulnerable to a load, the strength of the supporter 132 can be improved by reinforcing the step difference with a rib.

Hereinafter, with reference to FIGS. 1 to 7, the lower side (the lower portion of the suction department 100) of the blowing fan 102*a* will be described. As long as the lower portion of the suction department can transmit a load or external force transmitted from the upper portion to the ground and have the suction port 101 and the filter 103, the lower portion may be anyone. Accordingly, the core of the technical idea of the present disclosure is not limited by the specific shape of the lower portion of the suction department 100.

An inlet grill 106 may be disposed at the air inlet 102*aa* of the blowing fan 102*a*. When the filter 103 is separated, the inlet grill 106 may prevent the user's fingers from entering the blowing fan 102*a*, thereby protecting the user and the blowing fan 102*a*.

The filter 103 may be disposed below the inlet grill 106, and a blowing fan 102*a* may be disposed above the inlet grill 106. The inlet grill 106 may have a plurality of through holes formed in the up-down direction so that air can flow. The inlet grill 106 may be connected to and fixed to a bell mouth 107*ca*.

The filter column 104 may extend in the up-down direction. The filter column 104 can be understood as a vertical member. The filter column 104 may have a shape extending downward from the periphery of the housing 160 (or the rim 107*c*). A plurality of filter columns 104 may be spaced apart from each other along the periphery of the housing 160 (or the rim 107*c*). The filter column 104 may receive a load or external force from the housing 160 (or the rim 107*c*) and transmit the load or external force to a base 108. Meanwhile, when it is understood that the rim 107*c* is included in the ground 107, the filter column 104 can be understood as being connected to the ground 107 below the ground 107.

The filter column 104 may be disposed between the filter 103 and the filter cover 105. The filter column 104 may be understood as being disposed along the periphery of the blower 1. Accordingly, the filter column 104 may be understood as providing a filter installation space Vf to allow the filter 103 to be installed in the inner space of the blower 1. The filter installation space Vf may be secured by the filter column 104. A length of the filter column 104 in the up-down direction may be equal to or longer than a length of the filter 103 in the up-down direction.

A thickness of the filter column 104 may be determined considering the structural strength as a support structure and the sufficient size of the filter installation space Vf together.

The filter 103 may be disposed inside the plurality of filter columns 104. An inner surface of the filter column 104 may face an outer surface of the filter 103. The inner surface of the filter column 104 may be in contact with the outer surface of the filter 103 to directly fix or support the filter 103.

When the filter 103 is detachably formed, the filter column 104 may be disposed outside a detachable direction of the filter 103. For example, when the filter 103 is detached forward, the filter column 104 may be disposed in an orientation other than the front.

The filter 103 may be formed in a cylindrical shape with a hollow inside which is open in the up-down direction. The filter 103 may be disposed below the blowing fan. The hollow inside the filter 103 may be aligned with the above-described inlet grill 106, the opening at the lower end of the rim 107*c*, or the air inlet 102*aa* of the blowing fan 102*a*. The outer surface of the filter 103 may face the suction port 101.

The air sucked in from the suction inlet may flow into the hollow inside the filter 103 while being purified by passing through the filter 103. The air introduced into the hollow inside the filter 103 may be sucked into the air inlet 102*aa* of the blowing fan 102*a* while passing through the inlet grill 106.

The filter cover 105 may be provided as an outer appearance or an outer sleeve of the suction department 100. The filter cover 105 may be an outer appearance or an outer sleeve of the lower portion of the suction department 100, and may also be provided together with the lower portion of the outer sleeve of the housing 160 as described above. The filter cover 105 may be understood as being connected to the housing 160 at the lower side of the housing 160.

The filter cover 105 may be formed in a form surrounding the filter 103. For example, when the filter 103 has a cylindrical shape, the filter cover 105 may be formed in the shape of a cylindrical peripheral surface. Alternatively, for example, in that the cross-sectional area of the blower 1 may decrease upward, the filter cover 105 may be formed in the shape of a peripheral surface of a truncated cone.

The length of the filter cover 105 in the up-down direction may correspond to the length of the suction department 100 in the up-down direction. For example, when the base 108, the filter 103, and the blowing fan 102*a* are accommodated in the suction department 100, a length of the filter cover 105 in the up-down direction may be close to the sum of lengths of the base 108, the filter 103, and the blowing fan 102*a* in the up-down direction.

The filter cover 105 may transfer a load transmitted from the outer sleeves of the distribution department 130 and the discharge departments 110 and 120 to the base 108. For example, an upper end of the filter cover 105 may be connected to lower ends of outer sleeves 114*o* and 124*o* of the outer departments 114 and 124 of the discharge departments 110 and 120. The upper end of the filter cover 105 may support the lower ends of the outer sleeves 114*o* and 124*o* of the outer departments 114 and 124 of the discharge departments 110 and 120. The lower end of the filter cover 105 may be supported by the base 108.

The filter 103 may be disposed inside the filter cover 105. The filter cover 105 is detachably formed so that the filter 103 can be inserted or detached.

The suction port 101 may be formed in the filter cover 105. A periphery of the filter cover 105 may be open to form a suction port 101. A plurality of suction ports 101 may be formed along the periphery of the filter cover 105. Each suction port 101 may be formed in a hole shape. The suction port 101 may be formed to correspond to a peripheral surface of the filter 103. The suction port 101 and the filter 103 may face each other. The suction port 101 may suck air in a direction of 360 degrees around the suction department 100.

The filter cover 105 may include a grill extending in an up-down direction on an outer surface. The grill may be in the form of a thin bar. A plurality of grills may be spaced apart from each other along the periphery of the filter cover 105. A separation distance between the grilles may be narrow enough to block foreign substances that may flow into the suction port 101. The grille extending in the up-down direction may be a vertical member of the supporting structure. That is, by providing the grille, the filter cover 105 can have structural strength capable of resisting the load and external force transmitted from the upper side of the filter cover 105.

The base 108 seated on the ground may be disposed on the lower side of the filter cover 105. The lower surface of the base 108 may be in contact with the bottom. The base 108 in planar cross-section may be formed corresponding to the lower ends of the filter 103 and the filter cover 105. For example, the base 108 may be formed in a disk shape.

The base 108 may be disposed on the lower side of the filter. The filter 103 may be seated on the upper surface of the base 108. The filter cover 105 may be connected to the upper surface of the base 108. The lower side of the filter column 104 may be connected to the upper surface of the base 108. The base 108 may support the filter cover 105 and/or the filter column 104. The base 108 may transmit a load or an external force transmitted from the filter cover 105 and/or the filter column 104 to the base 108 to the ground.

The base 108 includes a hollow therein, and an electrical unit made of a printed circuit board or the like may be formed in the hollow. The electrical unit may supply power to the fan motor 102*b*, the display, and the like.

Figure 4:
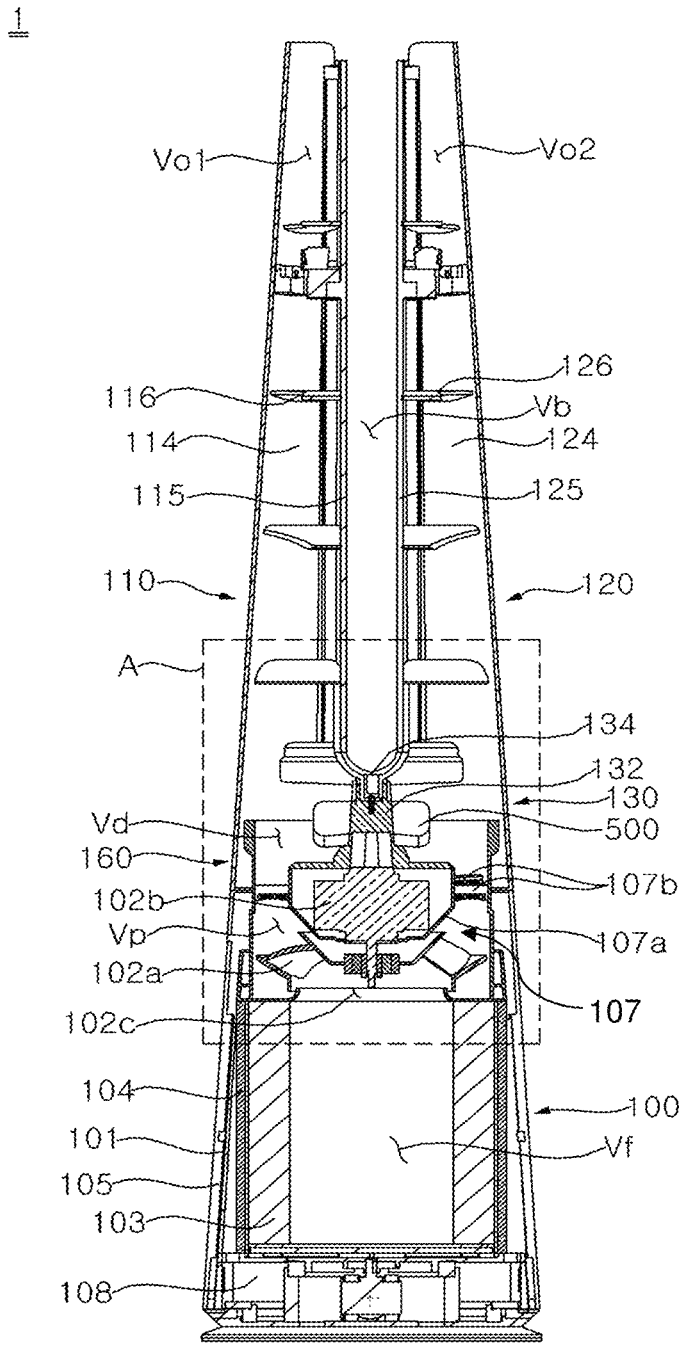
FIG. 4 is a front cross-sectional view taken along line P-P' of FIG. 1.
Figure 5:
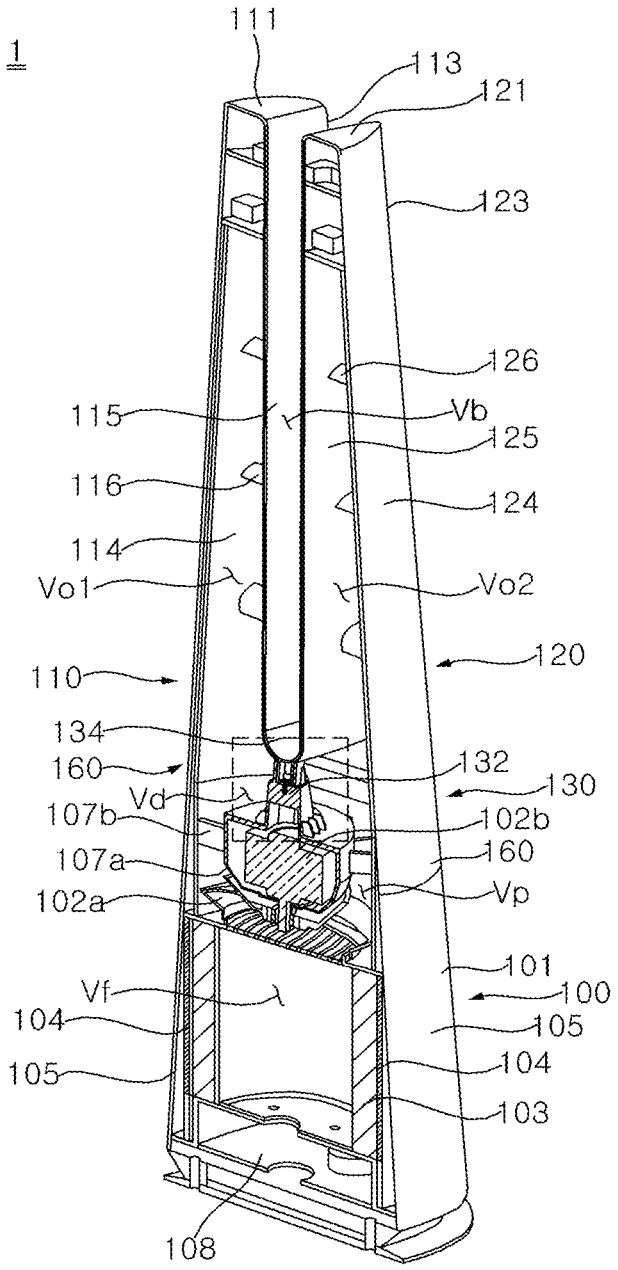
FIG. 5 is a perspective view of FIG. 4.
Figure 6:
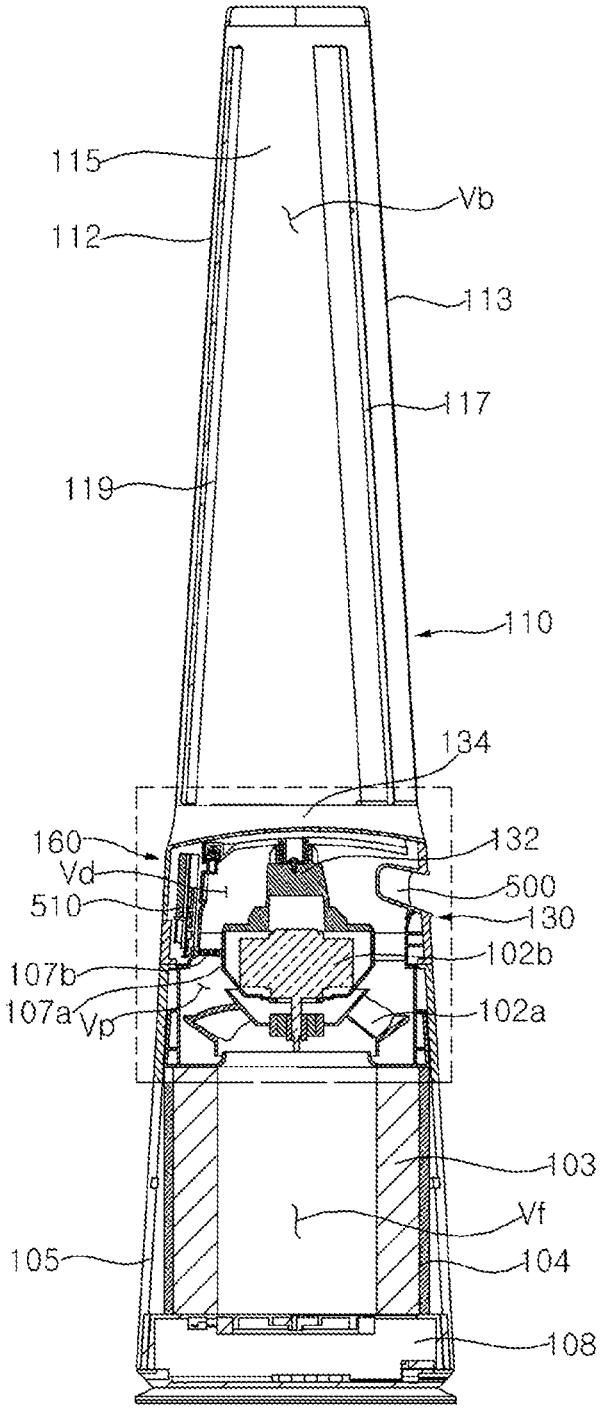
FIG. 6 is a side cross-sectional view taken along line Q-Q' of FIG. 1.
Figure 7:
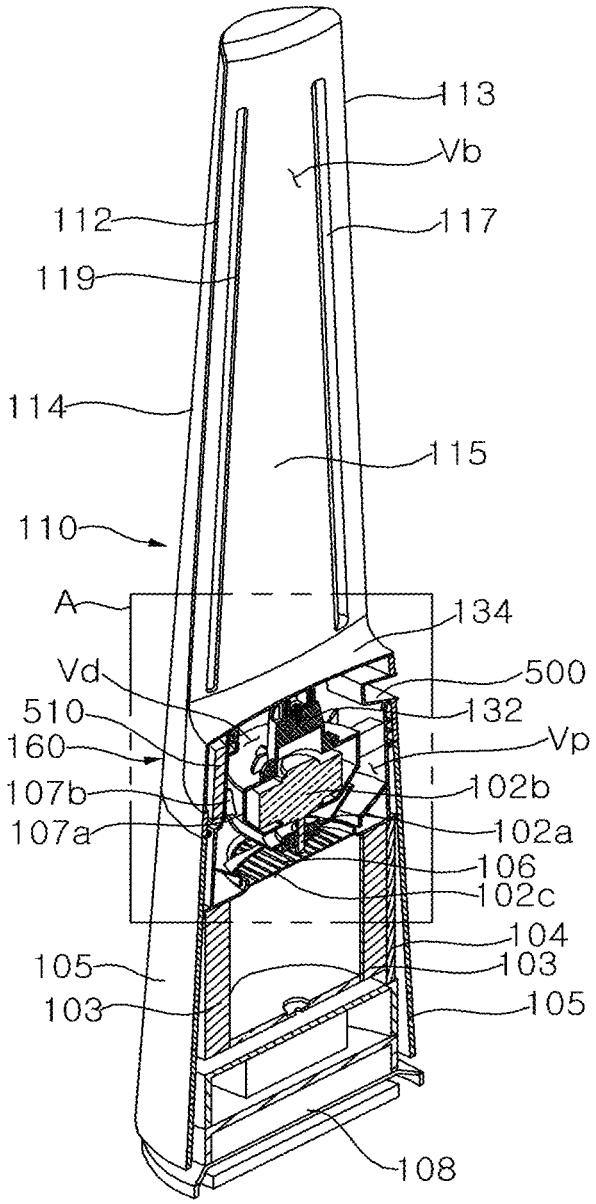
FIG. 7 is a perspective view of FIG. 6.

The air guide will be described with reference to FIGS. 4 and 5. The air guide for converting the flow direction of air to the horizontal direction may be disposed in the discharge space. The air guide converts the air flowing from the lower side to the upper side in the horizontal direction, and the diverted air may flow to the discharge port. In addition, the air guide can ensure that air is evenly distributed over the entire surface of the discharge port formed long.

When it is necessary to distinguish the air guide, the air guide disposed inside the first discharge department 110 may be referred to as a first air guide 116, and the air guide disposed inside the second discharge department 120 may be referred to as a second air guide 126. The first air guide 116 and the second air guide 126 may be symmetrical to each other. In order to avoid repetition of the same description, it is natural that the description of either one of the air guides can be applied to the other air guide even when not otherwise noted.

A plurality of air guides may be disposed along the longitudinal direction of the discharge port. In order to guide the air flowing from the lower side to the discharge port, at least one of the plurality of air guides may be formed as an upper convex curved surface.

The air guide may be coupled to the inner surfaces of the outer departments and the inner surfaces of the inner departments of the discharge departments 110 and 120. The air guide may have a rear end portion disposed close to the discharge port 117. The air guide may be disposed closer to the rear ends 113 and 123 of the discharge departments 110 and 120 than to the front ends 112 and 122.

At least one of the plurality of air guides may have a front end portion lower than a rear end portion.

The plurality of air guides may be formed such that a degree of inclination of the front end portion toward the blowing fan 102*a* side increases as the air guide is disposed closer to the blowing fan 102*a*.

Figure 14:
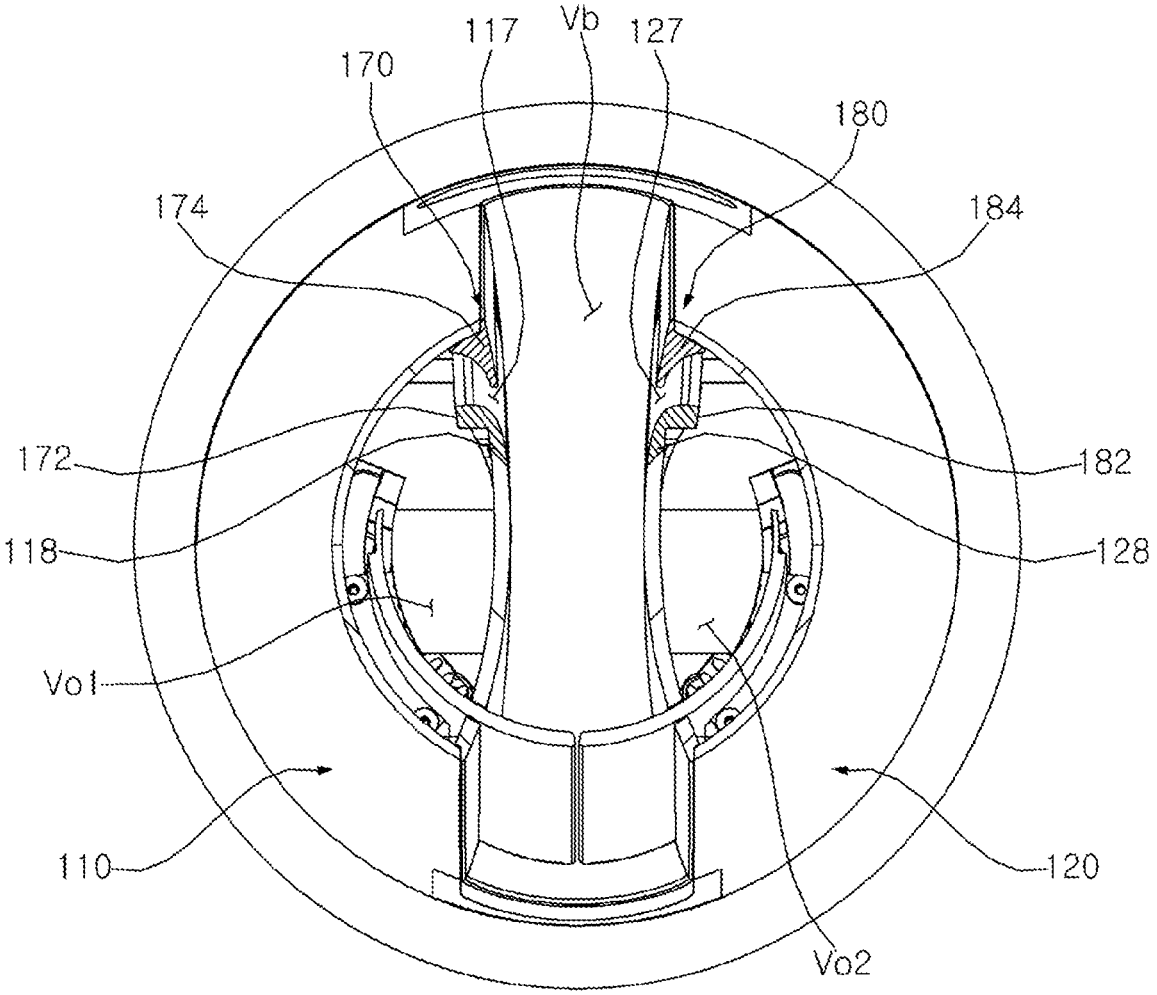
FIG. 14 is a plan view of a section taken along line IX-IX of FIG. 3.
Figure 15:
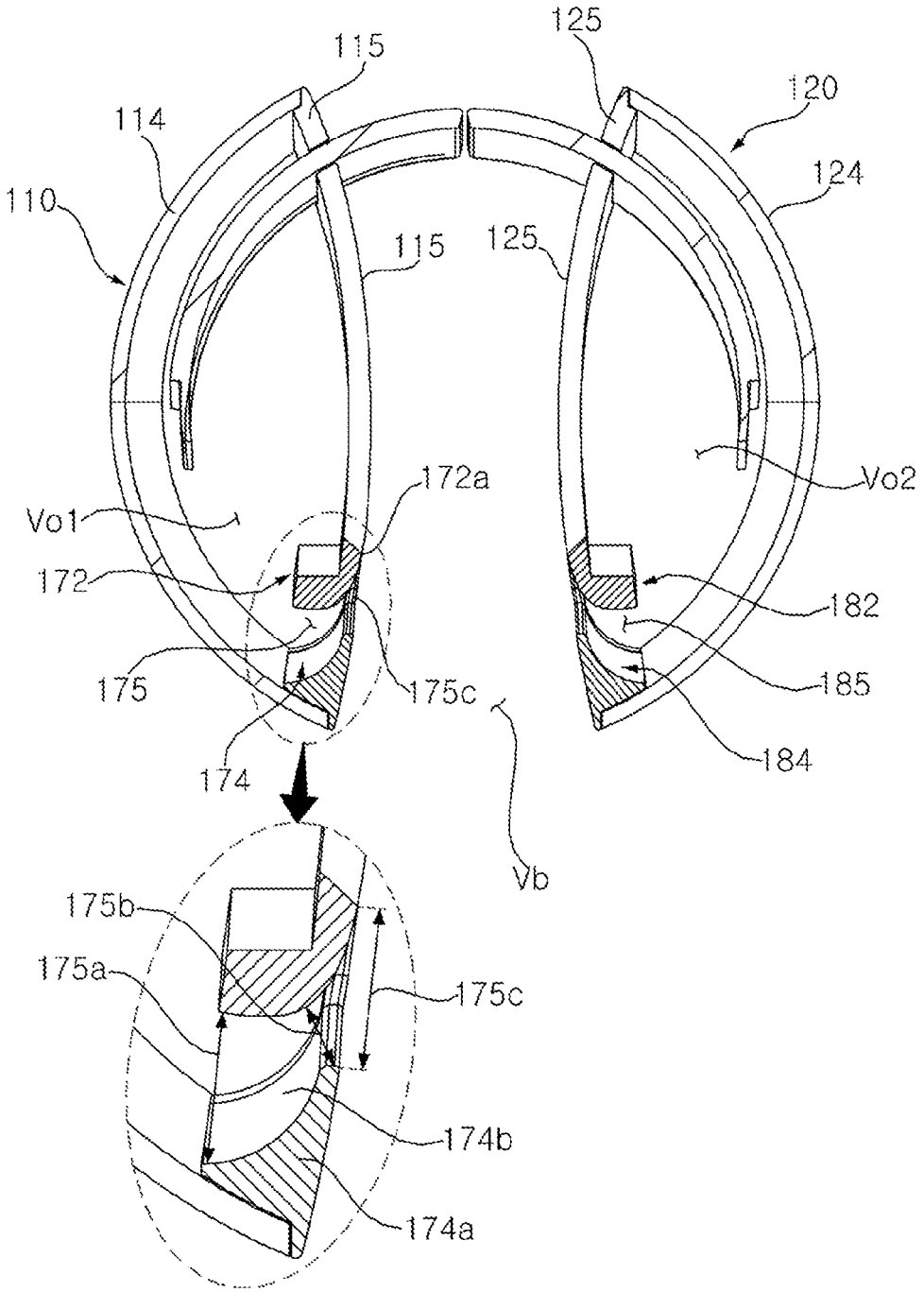
FIG. 15 is a bottom view of a section taken along line IX-IX of FIG. 3.
Figure 16:
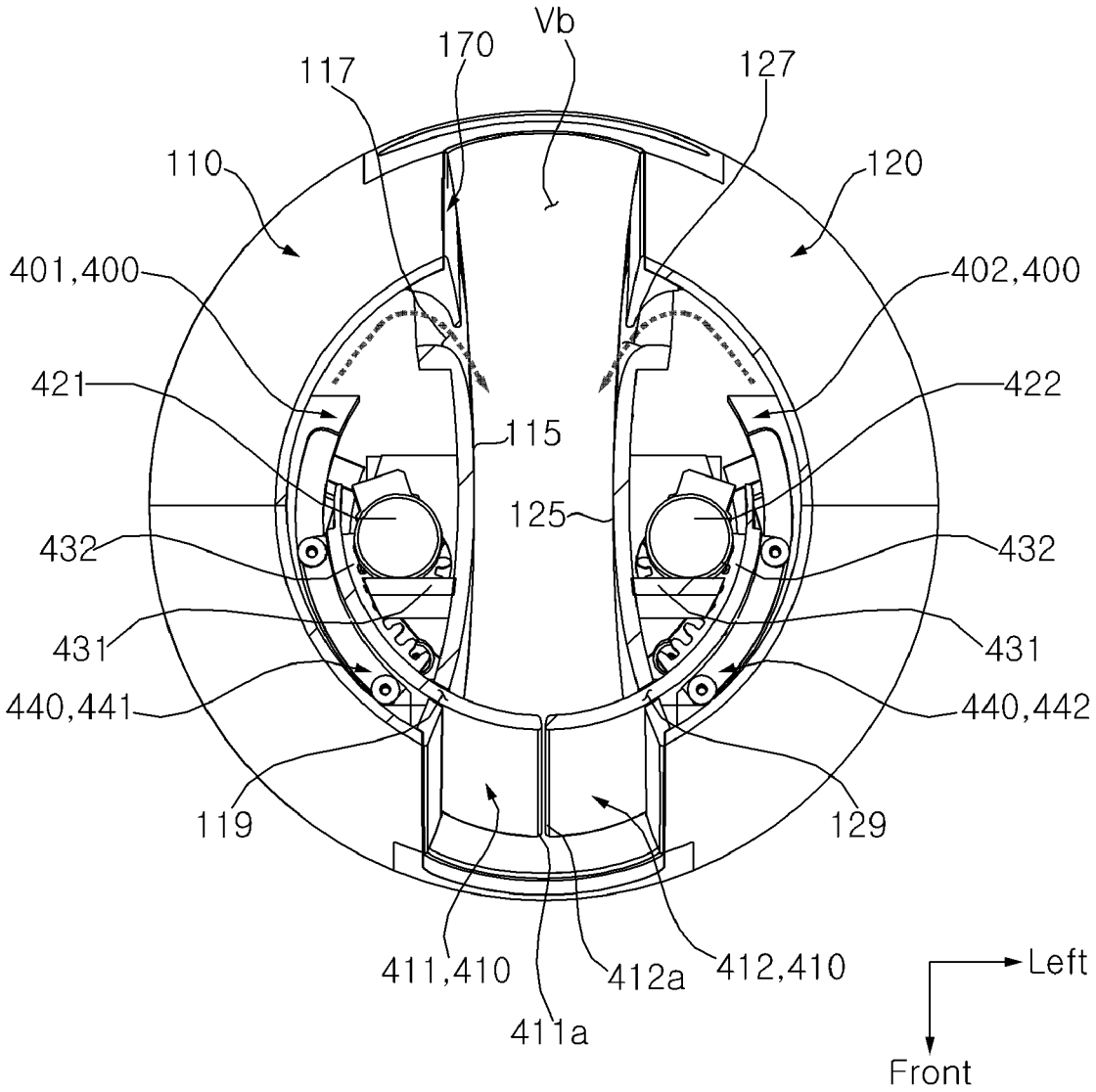
FIG. 16 is a transmittance diagram of FIG. 13.

Next, the specific shape of the discharge port will be described with reference to FIGS. 14 to 16. The discharge port may be formed such that discharged air is discharged toward an air discharge direction (for example, forward). In addition, the discharge port may be formed so that discharged air smoothly flows along the inner department.

The first discharge port 117 may be disposed between the front end 112 and the rear end 113 of the first discharge department 110 and disposed close to the rear end 113. The first discharge port 117 may be disposed in the first inner department 115. The air discharged from the first discharge port 117 may flow along the first inner department 115 by the Coanda effect and may flow toward the front end 112 of the first discharge department 110.

The first discharge port 117 may be disposed to be inclined in the up-down direction. Specifically, the first discharge port 117 may be disposed to be inclined toward the front side. The front end 112 and the rear end 113 of the first discharge department 110 may also be inclined with respect to the up-down direction. The front end 112 of the first discharge department 110 may be inclined toward the rear side. The rear end 113 of the first discharge department 110 may be inclined toward the front side. A slope of the first discharge port 117 may be greater than a slope of the front end 112 or the rear end 113 of the first discharge department 110.

The second discharge port 127 may be left-right symmetrical with the first discharge port 117, and the second discharge department 120 may be left-right symmetrical with the first discharge department 110. Accordingly, redundant descriptions of the second discharge port 127 and the second discharge department 120 will be omitted.

Meanwhile, the discharge departments 110 and 120 may have a discharge opening formed by opening a larger area than the discharge port. The discharge port may be formed by a discharge case assembled to the discharge opening.

A first discharge opening 118 may be formed in the first discharge department 110. A first discharge case 170 may be assembled to the first discharge opening 118. A second discharge opening 128 may be formed in the second discharge department 120. A second discharge case 180 may be assembled to the second discharge opening 128.

The first discharge opening 118 may be formed in the first inner department 115. The first discharge case 170 may be disposed to pass through the first inner department 115. The second discharge opening 128 may be formed in the second inner department 125. The second discharge case 180 may be disposed to pass through the second inner department 125.

The first discharge case 170 may include a first discharge guide 172 disposed on the air discharge direction side (for example, front side) and a second discharge guide 174 disposed on the opposite side (for example rear side) of the air discharge direction.

An outer surface 172*a* of the first discharge guide 172 and an outer surface 174*a* of the second discharge guide 174 may provide a portion of the first inner department 115.

An inner surface 172*b* of the first discharge guide 172 may be disposed toward the first discharge space Vo1, and an outer surface 172*a* of the first discharge guide 172 may be disposed toward the blowing space Vb. An inner surface 174*b* of the second discharge guide 174 may be disposed toward the first discharge space Vo1, and an outer surface 174*a* of the second discharge guide 174 may be disposed toward the blowing space Vb.

The outer surface 172*a* of the first discharge guide 172 may form a continuous curved surface with the outer surface of the first inner department 115. The outer surface 174*a* of the second discharge guide 174 may form a continuous curved surface with the outer surface of the first inner department 115. The inner surface 174*b* of the second discharge guide 174 may form a continuous curved surface with the inner surface of the first outer department 114 and air in the first discharge space Vo1 may be guided to the first discharge guide 172 along the curved surface.

The first discharge port 117 may be formed between the first discharge guide 172 and the second discharge guide 174, and air in the first discharge space Vo1 may be discharged to the blowing space Vb through the first discharge port 117.

Specifically, air in the first discharge space Vo1 may be discharged between the outer surface 172*a* of the first discharge guide 172 and the inner surface 174*b* of the second discharge guide 174. A portion between the outer surface 172*a* of the first discharge guide 172 and the inner surface 174*b* of the second discharge guide 174 may be defined as a discharge interval 175. The discharge interval 175 may form a predetermined channel.

In the discharge interval 175, a width of a middle portion 175*b* is narrower than those of an inlet 175*a* and an outlet 175*c*.

A cross-sectional area of the discharge gap 175 may gradually decrease from the inlet 175*a* to the middle portion 175*b* and gradually increase from the middle portion 175*b* to the outlet 175*c*. The middle portion 175*b* may be located inside the first discharge department 110. When viewed from the outside, the outlet 175*c* of the discharge interval 175 may be seen as the first discharge port 117.

A curvature radius of the inner surface 174*b* of the second discharge guide 174 may be larger than a curvature radius of the outer surface 172*a* of the first discharge guide 172 so that the air discharged from the first discharge port 117 flows along the first inner department 115 by the Coanda effect and flows forward.

A center of curvature of the outer surface 172*a* of the first discharge guide 172 may be located in front of the outer surface 172*a* and may be formed inside the first discharge space Vo1. The center of curvature of the inner surface 174*b* of the second discharge guide 174 may be located on the side of the first discharge guide 172 and formed inside the first discharge space Vo1.

The second discharge case 180 may include a first discharge guide 182 which forms the second discharge port 127 and is disposed on the air discharge side of the second discharge port 127, and a second discharge guide 184 which forms the second discharge port 127 and is disposed on a side opposite to the air discharge side of the second discharge port 127.

A discharge gap 185 may be formed between the first discharge guide 182 and the second discharge guide 184.

Since the second discharge case 180 may be formed left-right symmetrically with the first discharge case 170, a detailed description of the second discharge case 180 may be omitted.

The air current converter 400 will be described with reference to FIGS. 1 to 3 and FIGS. 16 to 18 (particularly, FIG. 16). The blower 1 may further include the air current converter 400 that changes the air flow direction in the blowing space Vb.

The air current converter may convert a horizontal airflow through the blowing space Vb into an upward air flow.

The air current converter may include a first air current converter 401 disposed in the first discharge department 110 and a second air current converter 402 disposed on the second discharge department 120. The first air current converter 401 and the second air current converter 402 are left-right symmetrical and may have the same configuration.

The air current converter may include a guide board 410 which is disposed in the discharge departments 110 and 120 and protrudes into the blowing space Vb, a guide motor 420 which provides a driving force for the movement of the guide board 410, a power transmission member 430 which provides the driving force of the guide motor 420 to the guide board 410, and a board guider 440 which is disposed inside the discharge departments 110 and 120 and guides the movement of the guide board 410.

The guide board 410 may be hidden inside the discharge departments 110 and 120 and protrude into the blowing space Vb when the guide motor 420 operates.

The guide board 410 may include a first guide board 411 disposed on the first discharge department 110 and a second guide board 412 disposed on the second discharge department 120.

To this end, a first board slit 119 penetrating the first inner department 115 of the first discharge department 110 may be formed, and a second board slit 129 penetrating the second inner department 125 of the second discharge department 120 may be formed.

The first board slit 119 and the second board slit 129 may be disposed left-right symmetrically. The first board slit 119 and the second board slit 129 may be formed long in the up-down direction. The first board slit 119 and the second board slit 129 may be disposed to be inclined in the up-down direction.

The slope of the first board slit 119 may be equal to or smaller than the slope of the front end 112 of the first discharge department 110. The slope of the second board slit 129 may be equal to or smaller than the slope of the front end 122 of the second discharge department 120.

The guide board 410 may be formed in a flat or curved plate shape. The guide board 410 may be formed long in the up-down direction. The guide board may be disposed in the front portion of the blowing space Vb. The guide board may be disposed at a position spaced apart from the discharge port in the air discharge direction (that is, the front side).

The guide board 410 can intercept the horizontal airflow flowing through the blowing space Vb and turn the airflow upward.

An inner end 411*a* of the first guide board 411 and an inner end 412*a* of the second guide board 412 may contact or come close to each other to form an upward airflow. Alternatively, the guide board 410 disposed on one discharge department may come into close contact with another discharge department to form the upward airflow.

When the air current converter is not operated, the inner end 411*a* of the first guide board 411 may close the first board slit 119, and the inner end 412*a* of the second guide board 412 may close the second board 129.

When the airflow converter is operated, the inner end 411*a* of the first guide board 411 may protrude into the blowing space Vb through the first board slit 119, and the inner end 412*a* of the second guide board 412 may protrude into the blowing space Vb through the second board slit 129.

The first guide board 411 and the second guide board 412 may protrude into the blowing space Vb by a rotation operation. In contrast, at least one of the first guide board 411 and the second guide board 412 may be linearly moved in a sliding manner and protrude into the blowing space Vb.

In a plan view, the first guide board 411 and the second guide board 412 may be formed in an arc shape. The first guide board 411 and the second guide board 412 form a predetermined curvature radius, and the center of curvature may be located in the blowing space Vb.

When the guide board 410 is hidden inside the discharge departments 110 and 120, it may be preferable that an inner volume of the guide board 410 in the radial direction is larger than an outer volume in the radial direction.

The guide motor 420 may include a first guide motor 421 providing rotational force to the first guide board 411 and a second guide motor 422 providing rotational force to the second guide board 412.

The rotation axes of the first guide motor 421 and the second guide motor 422 are disposed in a vertical direction, and a rack 432-pinion structure may be used to transmit a driving force.

The power transmission member 430 may include a drive gear 431 coupled to the motor shaft 102*ba* of the guide motor 420 and a rack 432 coupled to the guide board 410. A pinion gear is used as the drive gear 431 and may be rotated in a horizontal direction.

The rack 432 may be coupled to the inner surface of the guide board 410. The rack 432 may be disposed in the discharge spaces Vo1 and Vo2 and turned together with the guide board 410.

The board guider 440 may guide the turning motion of the guide board 410. The board guider 440 may support the guide mode 410 during the turning motion of the guide board 410.

Based on the guide board 410, the board guider 440 may be disposed on the opposite side of the rack 432. The board guider 440 may support the force applied from the rack 432. Unlike the present embodiment, a groove corresponding to a turning radius of the guide board may be formed in the board guider 440, and the guide board may be moved along the groove.

The board guider 440 may be assembled to the outer department of the discharge departments 110 and 120. The board guider 440 may be disposed radially outside with respect to the guide board 410, and through this, contact with air flowing through the discharge spaces Vo1 and Vo2 may be minimized.

Referring to FIG. 17, when providing the horizontal airflow, the first guide board 411 may be hidden inside the first discharge department 110, and the second guide board 412 may be hidden inside the second discharge department 120.

The discharge air of the first discharge port 117 and the discharge air of the second discharge port 127 are joined in the blowing space 120 and flow forward through the front ends 112 and 122 of the discharge departments 110 and 120.

Air at the rear of the blowing space Vb may flow forward after being guided into the blowing space Vb. In addition, air around the first discharge department 110 may flow forward along the first outer department 114, and air around the second discharge department 120 may flow forward along the second outer department 124.

Referring to FIG. 18, when providing the upward airflow, the first guide board 411 and the second guide board 412 may protrude into the blowing space Vb and cover the front of the blowing space Vb.

As the front of the blowing space Vb is covered by the first guide board 411 and the second guide board 412, the air discharged from the discharge port may be raised through the first guide board 411 and the second guide board 412 and discharged to the upper portion of the blowing space Vb.

By forming the upward airflow in the blower 1, it is possible to suppress the direct flow of discharged air to the user. Moreover, when trying to circulate indoor air, the blower 1 can be operated with the upward airflow.

For example, when an air conditioner and blower 1 are used simultaneously, convection of indoor air can be promoted by operating blower 1 as the upward airflow, and the indoor air can be cooled or heated more quickly.

An object of the present disclosure is to provide a finishing module for mounting an air conditioner that can solve the problems of the related art.

Another object of the present disclosure is to provide a blower having excellent rigidity against an external force even having a plurality of discharge ports on an upper side.

Still another object of the present disclosure is to provide a blower capable of securing excellent blowing performance even when a load support structure is provided inside the blower.

Still another object of the present disclosure is to provide a blower in which a load support structure has forms or functions of other structures required inside the blower to improve space efficiency.

The tasks of the present disclosure are not limited to the tasks mentioned above, and other tasks not mentioned will be clearly understood by those skilled in the art from the description below.

According to an aspect of the present disclosure, there is provided a blower including: a housing through which air is introduced; a plurality of discharge departments disposed above the housing, each having a discharge port, and facing each other; and a blowing space formed to be spaced at least partly between the plurality of discharge departments facing each other and open at least front and rear.

It can be understood that the plurality of discharge departments are connected in parallel to the housing with a blowing space therebetween. Accordingly, the blowing fan forming the flow of air may be disposed on an upstream side of the inner space of the blower from the upper portion of the housing. Air pressurized by the blowing fan may flow upward and be discharged to the outside after being distributed to the plurality of discharge departments.

The blower according to the present disclosure includes a ground disposed on a downstream side of the blowing fan, spaced downward from the plurality of discharge departments, and connected to the housing, and a supporter extending upward from the ground to support the plurality of discharge departments.

Since the ground is spaced downward from the discharge department, a distribution space, which is a pressure buffer zone, can be secured therebetween, thereby reducing pressure loss and vortex generation. Moreover, structural stability of the blower can be improved by supporting the discharge department by the supporter and ground disposed inside the housing.

The first discharge department may be divided into a first inner department, which is a portion facing the blowing space, and a first outer department, which is a portion not facing the blowing space, of the first discharge department, and the second discharge department may be divided into a second inner department, which is a portion facing the blowing space, and a second outer department, which is a portion not facing the blowing space, of the second discharge department. In this case, the supporter may be connected to the first inner department and the second inner department. The supporter may be connected to a portion of the first discharge department and the second discharge department corresponding to the blowing space in the up-down direction.

Therefore, structural rigidity of the blower can be improved by the supporter supporting the inner department near the center of gravity of the first discharge department and the second discharge department.

The first outer department and the second outer department may be connected to the housing.

Therefore, by connecting the outer portion of the blowing space of the periphery of the discharge department to the lower housing, a portion of the load of the discharge department is directly transferred to the housing while communicating an internal flow path of the housing and the internal flow path of the discharge department, and thus, the structural rigidity of the blower can be improved.

The supporter may include a body extending in an up-down direction, a protrusion extending upward from the body to form a periphery, and connecting the first discharge department and the second discharge department to the supporter inside the periphery, and an extension portion extending laterally below the body and connected to the ground.

In the supporter, the extension portion may have a flat cross-sectional area larger than that the body. In the support, the body may have a flat cross-sectional area lager than that of the protrusion.

Therefore, through the shape design of the supporter considering a flow path width of a distribution space, the flat cross-sectional area of the distribution space gradually increases as it approaches the discharge space. Accordingly, it is possible to smoothly distribute the airflow from the lower surface to each discharge flow path to prevent turbulence from occurring while the supporter plays a role as a support structure placed in the distribution space.

the supporter may further include a first rib connecting the protrusion and the body, and a second rib connecting the body and the extension portion.

Therefore, even when a step difference occurs while the flat cross-sectional area of each portion of the supporter according to the height is differentiated, the rigidity of the supporter can be improved by reinforcing the step difference with a rib.

The supporter may be disposed in a portion vertically corresponding to the blowing space in the inner space of the housing.

Therefore, by disposing the supporter in a portion other than a section going straight from the blowing fan to the discharge flow path, it is possible to minimize a flow resistance due to the supporter.

The first discharge department and the second discharge department may be disposed on left and right about the blowing space, a width of the blowing space in a front-rear direction may be longer than a width of the blowing space in a left-right direction, and a length of the supporter in the front-rear direction may be longer than a length of the supporter in the left-right direction.

Therefore, even when the lengths of the first discharge department and the second discharge department in the front-rear direction increase (that is, Coanda effect is increased by securing a wide Coanda surface) in order to increase an air volume of the blower, correspondingly, the discharge department can be stably supported by forming the supporter long in the front-rear direction.

The first discharge department and the second discharge department may further include a bridge that extends laterally and connects lower portions of the first discharge department and the second discharge department facing each other, and the supporter may be connected to a lower surface of the bridge.

Therefore, the load of the discharge department can be evenly transferred to the supporter by connecting a lower portion of a spaced gap between the first discharge department and the second discharge department to the bridge extending laterally and connecting the supporter to the lower surface of the bridge.

The supporter may be connected to the vicinity of a center of the lower surface of the bridge. The supporter may be connected to a central part of the lower surface of the bridge. Therefore, the structural rigidity of the blower can be improved by the supporter supporting a center of gravity of the bridge.

The bridge may be recessed downward. The bridge may be convex downward. Therefore, in that air that does not go straight to the discharge flow path through a pressurized space can collide with the bridge and flow into the discharge flow path, by forming the shape of the bridge as a curved surface recessed downward, the flow resistance can be reduced due to collision with the bridge.

The first discharge department may include a first insertion portion that extends downward from a lower portion of the first discharge department and is inserted into the protrusion, and the second discharge department may include a second insertion portion that extends downward from a lower portion of the second discharge department and is inserted into the protrusion.

Therefore, even when the two spaced apart discharge departments are particularly vulnerable to lateral external force (retracting or spreading force), the structural rigidity of the blower can be improved by providing the protrusion forming a lateral periphery at the connection portion between the supporter and the discharge department and the insertion portion inserted into the protrusion.

Any one of the first insertion portion and the second insertion portion may be formed in a shape corresponding to an inner periphery of the protrusion and fastened with the protrusion in an interference fit manner. In this case, the other one of the first insertion portion and the second insertion portion may be formed in a shape corresponding to an inner periphery of the one and fastened with the one in an interference fit manner.

Therefore, it is possible to improve assemblability of the blower by adopting a sequential interference fit manner in the fastening method between the discharge department and the supporter.

Each of the first insertion portion and the second insertion portion may include a bolting surface facing an upper surface of each body, and the bolting surface of the first insertion portion and the bolting surface of the second insertion portion are overlapped vertically and are bolted to the upper surface of the body by a single bolt.

Accordingly, the stacked supporter, first insertion portion, and second insertion portion can be fixed with only a single bolting, so that the assemblability of the blower can be improved.

The blower may further include a first structure that is disposed in a portion of the housing having a height corresponding to the supporter and protrudes into the housing by a predetermined first distance. The supporter may include a first surface facing the first structure, and the first surface may be inclined at a predetermined first angle in a direction in which the first structure protrudes.

The blower may further include a second structure which is disposed in a portion of the housing having a height corresponding to the supporter and protrudes into the housing by a second distance smaller than the first distance. The supporter may include a second surface facing the second structure, and the second surface may be inclined at a second angle smaller than the first angle in a direction in which the second structure protrudes.

Therefore, by forming the supporter inclined in response to the structure intruding into the distribution space, it is possible to secure the flow path width of the distribution space even when the structure is arranged.

A hollow may be formed inside a lower portion of the supporter.

Therefore, it is possible to reduce material costs by forming the lower portion inside the supporter in a hollow shape, and also, in a case where the ground functions as a motor housing, even when the fan motor protrudes upward from the upper surface of the ground, the supporter can be placed without interference.

The ground may be disposed above the blowing fan, and include a hub spaced inwardly from the housing and a spoke connecting the hub and the housing.

Therefore, the space efficiency of the blower can be improved by enabling the ground to function as a diffuser that improves blowing performance of the blower and also as a support structure that transfers the load received from the supporter to the housing.

In addition, the ground as a diffuser promotes proper pressurization and flow direction conversion of the air discharged from the blowing fan, and thus, even in a structure in which the discharge port extends in the up-down direction, the air can reach uniformly throughout the discharge port.

A fan motor providing a driving force to the fan may be disposed inside the hub.

That is, the space efficiency of the blower can be further improved by using the inner space of the hub as a housing for the fan motor.

The ground may further include a rim spaced outwardly from the hub and connected to the housing, and the spoke may connect the hub and the rim.

Therefore, it is possible to improve manufacturability of the blower by separately making the diffuser-combining ground including the rim, hub, and spoke and then simply fastening the diffuser-combining ground to the housing.

Details of other embodiments are included in the detailed description and drawings.

The blower according to the present disclosure has one or more of the following effects.

First, the blower according to the present disclosure may have excellent rigidity against an external force even having the plurality of discharge ports on an upper side.

Second, the blower according to the present disclosure can secure excellent blowing performance even when a load support structure is provided inside the blower.

Third, in the blower according to the present disclosure, the load support structure has forms or functions of other structures required inside the blower to improve space efficiency.

Effects of the present disclosure are not limited to the effects mentioned above, and other effects not mentioned may be clearly understood by those skilled in the art from the description of claims.

A person with ordinary knowledge in the technical field to which the present disclosure belongs may be able to understand that the present disclosure may be implemented in other specific forms without changing its technical spirit or essential characteristics. Therefore, the embodiments described above may be understood as illustrative in all respects and not limiting. The scope of the present disclosure is indicated by the scope of the claims to be described later rather than the detailed description, and all changes or modified forms derived from the meaning and scope of the claims and equivalent concepts may be construed as being included in the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present description.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the description. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this description belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the description. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A blower comprising:

a housing including a suction port into which air is introduced;

a fan provided inside the housing to blow air upward;

a first tower having a first tower space communicating with an inside of the housing and a first discharge port, the first tower being positioned above the suction port and extending upward;

a second tower having a second tower space communicating with the inside of the housing and a second discharge port, the second tower being positioned above the suction port, facing the first tower, and extending upward;

a blowing space formed between the first and second towers and open in at least one of a front direction or a rear direction;

a ground frame provided above the fan and connected to the housing, at least a portion of the ground frame being spaced downward from the first tower and the second tower, wherein a space is formed between the first and second towers and at least a portion of the ground frame; and a supporter frame provided below the space between the first and second towers and the at least a portion of the ground frame and extending upward from the ground frame to support the first tower and the second tower, wherein the first tower and the second tower further include a bridge that extends laterally and connects lower portions of the first tower and the second tower that are facing each other, wherein the supporter frame is connected to a lower surface of the bridge, wherein the supporter frame is connected to a center region of the lower surface of the bridge, and wherein the supporter frame includes a body extending in an up-down direction, a protrusion extending upward from the body to form a periphery, and connecting the first tower and the second tower to the supporter frame inside the periphery, and an extension portion extending laterally below the body and connected to the ground frame.

2. The blower of claim 1, wherein the first tower is divided into a first inner tower facing the blowing space, and a first outer tower that does not face the blowing space, wherein the second tower is divided into a second inner tower facing the blowing space, and a second outer tower that does not face the blowing space, and wherein the supporter frame is connected to the first inner tower and the second inner tower.

3. The blower of claim 2, wherein the first outer tower and the second outer tower are connected to the housing, and wherein a width of the blower gradually decreases in an upward direction.

4. The blower of claim 1, wherein in the supporter frame, a width of the extension portion is larger than a width of the body, and the width of the body is larger than a width of the protrusion.

5. The blower of claim 4, wherein the supporter frame further includes a first rib connecting the protrusion and the body, and a second rib connecting the body and the extension portion.

6. The blower of claim 1, wherein a width of the supporter frame gradually decreases along an upward direction.

7. The blower of claim 1, wherein the supporter frame is provided to be vertically aligned with the blowing space and in the inside of the housing.

8. The blower of claim 1, wherein the supporter frame is connected to a portion of at least one of the first tower or the second tower, and wherein the supporter frame is corresponding to the blowing space in the up-down direction.

9. The blower of claim 1, wherein the supporter frame extends upward from a center of the ground frame.

10. The blower of claim 1, wherein the first tower and the second tower are provided, respectively, left and right of the blowing space, a width of the blowing space in a front-rear direction is greater than a width of the blowing space in a left-right direction, and a length of the supporter frame in the front-rear direction is greater than a length of the supporter frame in the left-right direction.

11. The blower of claim 1, wherein the bridge is recessed downward.

12. The blower of claim 1, wherein the bridge is coupled to an upper surface of the supporter frame.

13. The blower of claim 1, further comprising a first protrusion that is provided in a portion of the housing having a height corresponding to that of the supporter frame and that protrudes into the housing by a first distance, wherein the supporter frame includes a first surface facing the first protrusion, and the first surface is inclined at a first angle relative to a vertical plane in a direction in which the first protrusion protrudes.

14. The blower of claim 13, further comprising a second protrusion which is provided in a portion of the housing having a height corresponding to the supporter frame and protrudes into the housing by a second distance smaller than the first distance, wherein the supporter frame includes a second surface facing the second protrusion, and the second surface is inclined at a second angle relative to the vertical plane smaller than the first angle in a direction in which the second protrusion protrudes.

15. The blower of claim 1, wherein a hollow space is formed inside a lower portion of the supporter frame.

16. The blower of claim 1, wherein at least a portion of the ground frame is provided above the fan, and the ground frame includes a hub spaced inwardly from the housing and a spoke connecting the hub and the housing.

17. The blower of claim 16, wherein a fan motor providing a driving force to the fan is provided inside the hub.

18. The blower of claim 16, wherein the ground frame further includes a rim spaced outwardly from the hub and connected to the housing, and the spoke connects the hub and the rim.

19. The blower of claim 18, wherein a separation distance between the supporter frame and the housing is greater than a separation distance between the hub and the rim.

20. The blower of claim 1, further comprising: a filter provided below the fan;

a filter cover having the suction port, detachably provided outside the filter, and connected to the housing at a lower side of the housing; and a filter column extending vertically between the filter and the filter cover to form an arrangement space for the filter and connected to the ground frame at a lower side of the ground frame.

21. The blower of claim 20, further comprising a base that is provided below the filter, is in contact with a bottom of the filter, and connected to lower sides of the filter cover and the filter column.

22. The blower of claim 1, wherein the space between the first and second towers and the at least a portion of the ground frame is communicated with the first tower space of the first tower and the second tower space of the second tower.

23. A blower of claim 1; comprising:

a housing including a suction port into which air is introduced;

a fan provided inside the housing to blow air upward;

a first tower having a first tower space communicating with an inside of the housing and a first discharge port, the first tower being positioned above the suction port and extending upward;

a second tower having a second tower space communicating with the inside of the housing and a second discharge port, the second tower being positioned above the suction port, facing the first tower, and extending upward;

a blowing space formed between the first and second towers and open in at least one of a front direction or a rear direction;

a ground frame provided above the fan and connected to the housing, at least a portion of the ground frame being spaced downward from the first tower and the second tower, wherein a space is formed between the first and second towers and at least a portion of the ground frame; and a supporter frame provided below the space between the first and second towers and the at least a portion of the ground frame and extending upward from the ground frame to support the first tower and the second tower, wherein the first tower and the second tower further include a bridge that extends laterally and connects lower portions of the first tower and the second tower that are facing each other, wherein the supporter frame is connected to a lower surface of the bridge, wherein the supporter frame is connected to a center region of the lower surface of the bridge, and wherein:

the supporter frame includes a body extending in an up-down direction, and a protrusion extending upward from the body, the first tower includes a first insertion extension that extends downward from a lower portion of the first tower and is received in the protrusion, and the second tower includes a second insertion extension that extends downward from a lower portion of the second tower and is received in the protrusion.

24. The blower of claim 23, wherein a first one of the first insertion extension or the second insertion extension is formed in the shape corresponding to an inner periphery of the protrusion and fastened with the protrusion based on interference between the first one of the first insertion extension or the second insertion extension and the inner periphery of the protrusion.

25. The blower of claim 24, wherein a second one of the first insertion extension or the second insertion extension is formed in a shape corresponding to an inner periphery of the first one of the first insertion extension or the second insertion extension and fastened with the first one of the first insertion extension or the second insertion extension based on interference between the second one of the first insertion extension or the second insertion extension and the inner periphery of the first one of the first insertion extension or the second insertion extension.

26. The blower of claim 23, wherein at least one of the first insertion extension or the second insertion extension includes a coupling surface that extends laterally from a lower end thereof and is in contact with an upper surface of the body, and the coupling surface is coupled to the upper surface of the body.

27. A blower, comprising:

a housing including a suction port into which air is introduced;

a fan provided inside the housing to blow air upward;

a first tower having a first tower space communicating with an inside of the housing and a first discharge port, the first tower being positioned above the suction port and extending upward;

a second tower having a second tower space communicating with the inside of the housing and a second discharge port, the second tower being positioned above the suction port, facing the first tower and extending upward;

a blowing space formed between the first and second towers and open in at least one of a front direction or a rear direction;

a ground frame provided above the fan and connected to the housing, at least a portion of the ground frame being spaced downward from the first tower and the second tower, wherein a space is formed between the first and second towers and at least a portion of the ground frame; and a supporter frame provided below the space between the first and second towers and the at least a portion of the ground frame and extending upward from the ground frame to support the first tower and the second tower, wherein the first tower and the second tower further include a bridge that extends laterally and connects lower portions of the first tower and the second tower that are facing each other, wherein the supporter frame is connected to a lower surface of the bridge, wherein the supporter frame is connected to a center region of the lower surface of the bridge, wherein at least a portion of the ground frame is provided above the fan, and the ground frame includes a hub spaced inwardly from the housing and a spoke connecting the hub and the housing, and wherein:

the supporter frame includes a body extending in an up-down direction, and an extension portion extending laterally from a lower portion of the body, and the extension portion is connected to an upper portion of the hub.

28. The blower of claim 27, wherein a peripheral portion of the extension portion is connected to a peripheral portion of the upper portion of the hub.

29. The blower of claim 27, wherein a thickness of the extension portion in the up-down direction is less than a width of the spoke in the up-down direction.

* * * * *